US008472839B2

(12) United States Patent
Kishi

(10) Patent No.: US 8,472,839 B2
(45) Date of Patent: Jun. 25, 2013

(54) PROCESS CARTRIDGE AND IMAGE FORMING APPARATUS

(75) Inventor: Yosuke Kishi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 301 days.

(21) Appl. No.: 13/044,888

(22) Filed: Mar. 10, 2011

(65) Prior Publication Data

US 2011/0222903 A1 Sep. 15, 2011

(30) Foreign Application Priority Data

Mar. 11, 2010 (JP) ..... 2010-054257

(51) Int. Cl.
*G03G 21/18* (2006.01)

(52) U.S. Cl.
USPC ..... 399/111

(58) Field of Classification Search
USPC ..... 399/111
See application file for complete search history.

(56) References Cited

U.S. PATENT DOCUMENTS

| | | | | |
|---|---|---|---|---|
| 6,385,420 | B1 | 5/2002 | Morioka | |
| 7,630,678 | B2 | 12/2009 | Kishi et al. | |
| 7,773,934 | B2 | 8/2010 | Kishi et al. | |
| 2009/0003876 | A1 * | 1/2009 | Maeshima et al. | 399/111 |

FOREIGN PATENT DOCUMENTS

| | | |
|---|---|---|
| JP | 2001-201914 | 7/2001 |

* cited by examiner

*Primary Examiner* — David Gray
*Assistant Examiner* — Michael Harrison
(74) *Attorney, Agent, or Firm* — Fitzpatrick, Cella, Harper & Scinto

(57) ABSTRACT

A process cartridge detachably mountable to a main assembly of an image forming apparatus includes a rotatable image bearing member on which an image is to be formed; a rotatable roller which is rotated and contacted to the image bearing member at least during image forming operation; and a supporting device for rotatably supporting a shaft of the rotatable roller at least during the image forming operation, the supporting device including an urging member for urging the rotatable roller toward the image bearing member, a bearing member having a holding portion for holding the shaft of the rotatable roller in a position where the rotatable roller is contacted to the image bearing member by the urging member, wherein a relative movement between the rotatable roller and the supporting device is possible by an external force between a first position in which the shaft of the rotatable roller is urged by the urging member while being held by the holding portion, and a second position in which the shaft of the rotatable roller is not held by the holding portion and in which a distance between a rotation axis of the image bearing member and an axis of the rotatable roller is longer than that in the first position.

15 Claims, 23 Drawing Sheets

(a)

(b)

(a)

(b)

PROCESS CARTRIDGE AND IMAGE FORMING APPARATUS

FIELD OF THE INVENTION AND RELATED ART

The present invention relates to a process cartridge and an image forming apparatus.

In the field of an electrophotographic image forming apparatus, it is known that a photosensitive drum as an image bearing member, a charging device, a developing device, a cleaning device or the like are contained integrally in a cartridge container (frame) and formed into a process cartridge. The process cartridge is detachably mountable to a main assembly of the image forming apparatus. By a user mounting it to the main assembly of the apparatus, the supply of the toner and exchange of the image bearing member can be carried out easily, so that the maintenance operation is easily accomplished. As for a charging device in the process cartridge, a non-contact type using corona discharge or the like and a contact type using a charging roller or the like of an electroconductive elastic material are generally used.

Recently, the contact type is widely used because of the less ozone production. In order to provide a uniform charging region (nip) between the photosensitive drum and the charging roller, the charging roller is always urged to the photosensitive drum by a spring or the like. In addition, a developing roller used in a contact type developing system and a transfer roller for transferring a toner image onto a recording material from the photosensitive drum are made of elastic material and are urged to the photosensitive drum. The process cartridge is shaped from the plant and is mounted to the main assembly of the apparatus by the user.

During distribution process to the mounting to the main assembly of the apparatus, the developing roller and the charging roller are kept contacted to the photosensitive drum in the process cartridge. By the urging, the developing roller and the charging roller may be deformed into conformity with the surface shape of the photosensitive drum to which they are urged.

The transfer roller provided in the main assembly of the apparatus is used for a longer term than the part constituting the process cartridge, and is kept contacted to the photosensitive drum as long as the process cartridge is set in the main assembly of the apparatus, and therefore, may be deformed into conformity with the photosensitive drum. When image forming operation is carried out using such a deformed developing roller, charging roller or transfer roller, the nip between the photosensitive drum and such a roller varies upon the deformed portion comes to face the photosensitive drum by the rotations. Therefore, a development defect, an improper charging, a transfer defect or the like results, thus deteriorating the image quality.

As a means for solving the problem, Japanese Laid-open Patent Application 2001-201914 discloses a method in which a spacer member is sandwiched between the and the surface of the photosensitive drum to maintain space therebetween when the process cartridge is not used, particularly during the transportation.

The spacer member is removed by the user before the start of use. U.S. Pat. No. 6,385,420 discloses a method in which a spacer member is released using a mechanism interrelated with actuation of the image forming apparatus without burden on the user.

SUMMARY OF THE INVENTION

The present invention further improves the prior-art structures.

It is an object of the present invention to provide a process cartridge and an image forming apparatus in which a rotatable roller which is rotated in contact with an image bearing member at least during image forming operation can be maintained in a state that it is not urged to the image bearing member without using complicated structures.

It is another object of the present invention to provide a process cartridge and a image forming apparatus in which a urging force of a rotatable roller to an image bearing member is made weaker than that during the image forming operation, by which the amount of deformation at a contacting position can be reduced, so that high image quality images can be provided stably.

According to an aspect of the present invention, there is provided a process cartridge detachably mountable to a main assembly of an image forming apparatus, said process cartridge comprising a rotatable image bearing member on which an image is to be formed; a rotatable roller which is rotated and contacted to said image bearing member at least during image forming operation; and a supporting device for rotatably supporting a shaft of said rotatable roller at least during the image forming operation, said supporting device including an urging member for urging said rotatable roller toward said image bearing member, a bearing member having a holding portion for holding the shaft of said rotatable roller in a position where said rotatable roller is contacted to said image bearing member by said urging member, wherein a relative movement between said rotatable roller and said supporting device is possible by an external force between a first position in which the shaft of said rotatable roller is urged by said urging member while being held by said holding portion, and a second position in which the shaft of said rotatable roller is not held by said holding portion and in which a distance between a rotation axis of said image bearing member and an axis of said rotatable roller is longer than that in the first position.

According to another aspect of the present invention, there is provided a image forming apparatus to which a process cartridge is detachably mountable, said process cartridge including a rotatable image bearing member on which an image is to be formed and a rotatable roller which is rotated and contacted to said image bearing member at least during image forming operation, said image forming apparatus comprising a supporting device for rotatably supporting a shaft of said rotatable roller at least during image forming operation, said supporting device including an urging member for urging said rotatable roller toward said image bearing member, and a bearing member having a holding portion for holding the shaft of said rotatable roller in a position where said rotatable roller is contacted to said image bearing member by said urging member, wherein a relative movement between said rotatable roller and said supporting device is possible by an external force between a first position in which the shaft of said rotatable roller is urged by said urging member while being held by said holding portion, and a second position in which the shaft of said rotatable roller is not held by said holding portion and in which a distance between a rotation axis of said image bearing member and an axis of said rotatable roller is longer than that in the first position.

These and other objects, features and advantages of the present invention will become more apparent upon a consideration of the following description of the preferred embodiments of the present invention taken in conjunction with the accompanying drawings.

Figure 6:
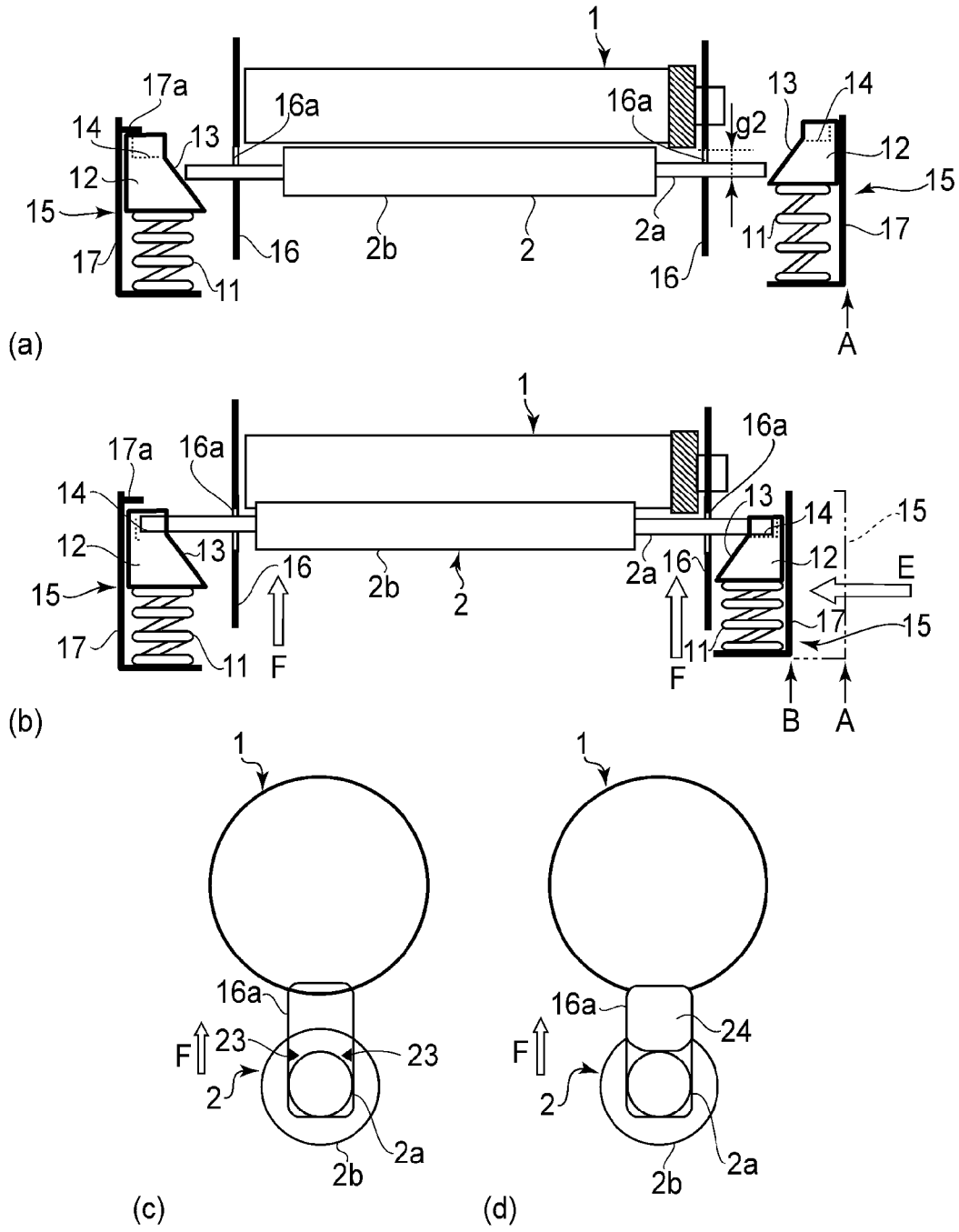

Part (a) and (b) of FIG. 6 are illustrations of a supporting device for the charging roller in Embodiment 3, (c) when (d) thereof are illustrations of a spacing means in Embodiment 4.

Figure 7:
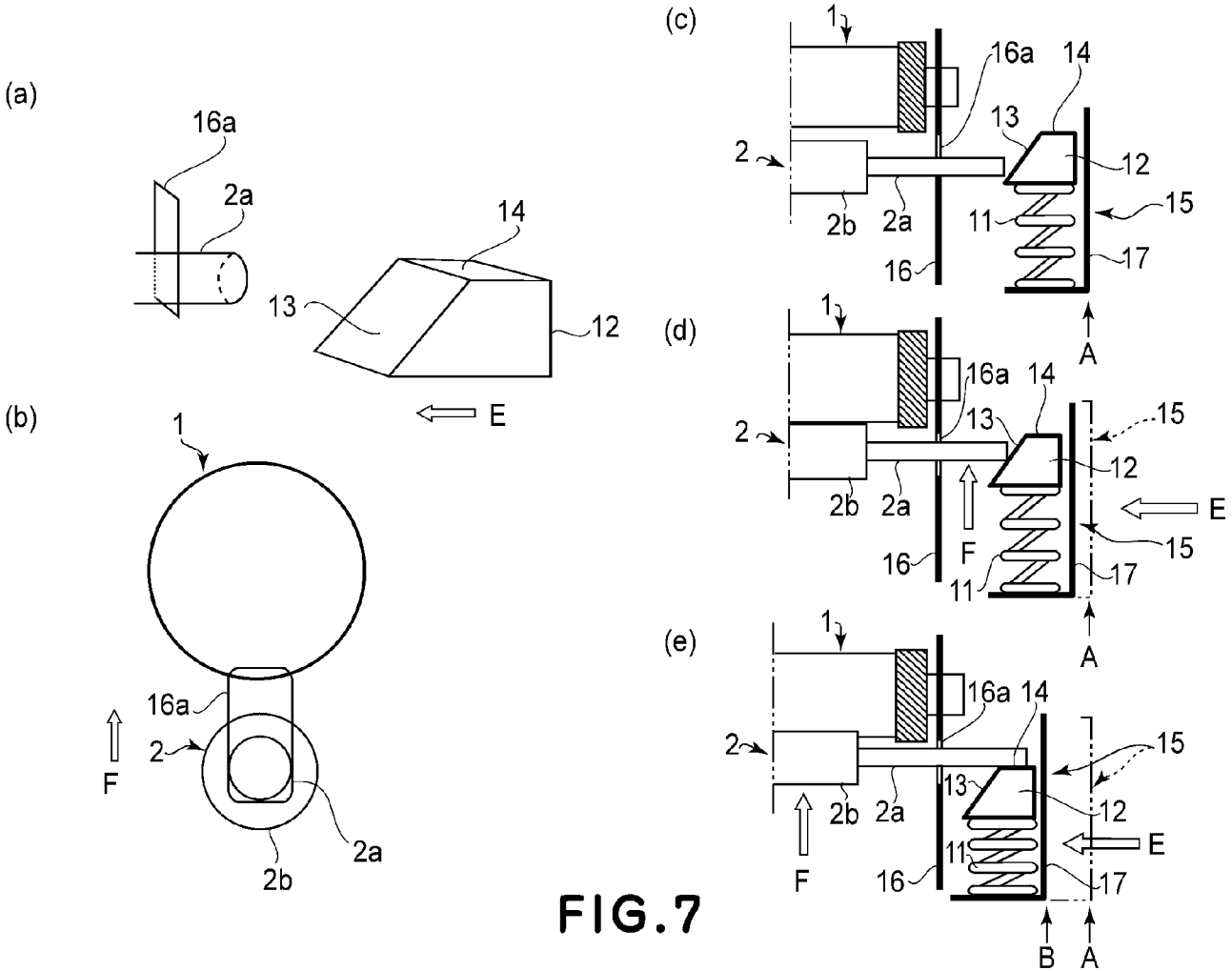

FIG. 7 is an illustration of the supporting device for the charging roller in Embodiment 5 of the present invention.

Figure 8:
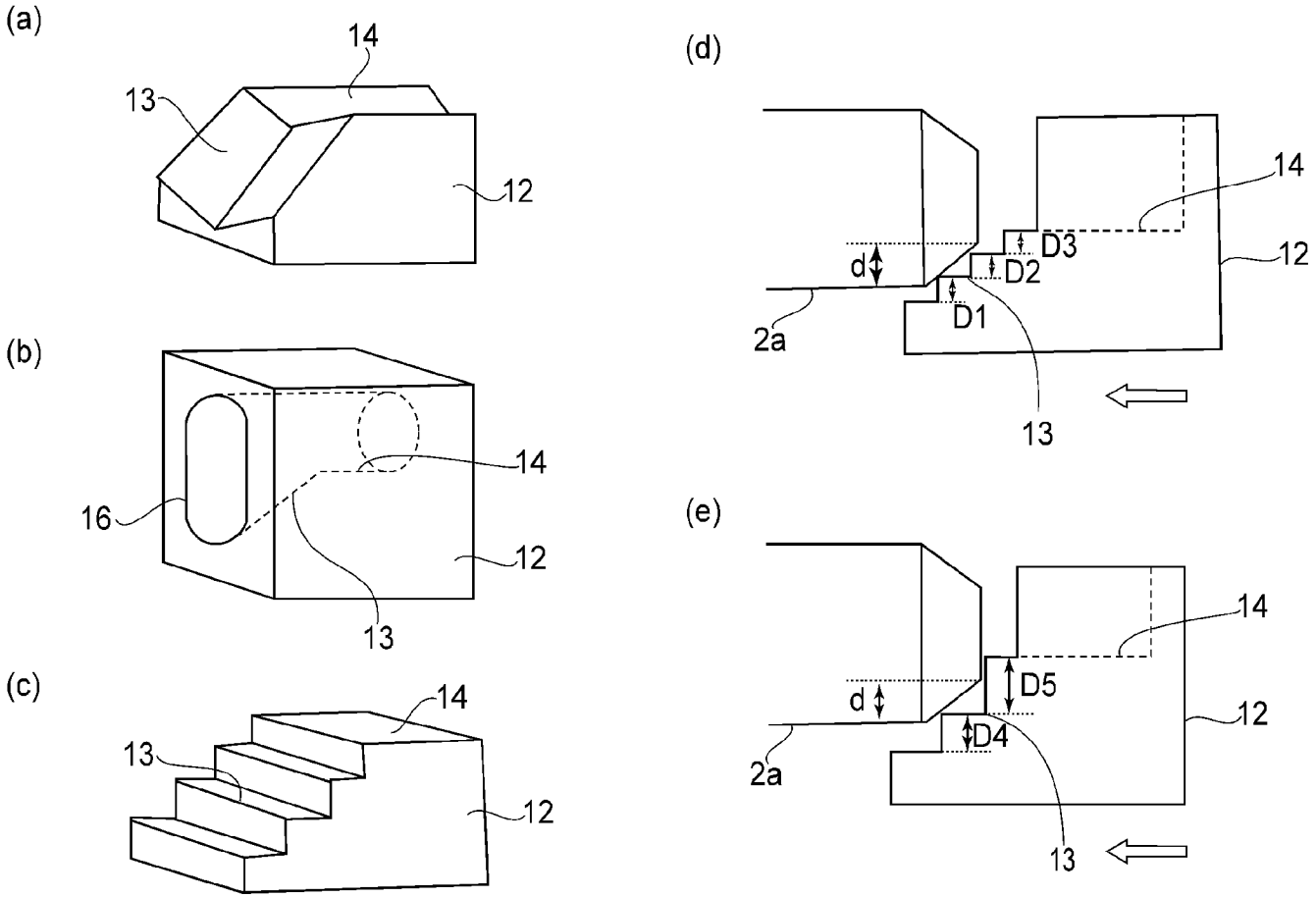

FIG. 8 is an illustration of various examples of a bearing member in Embodiment 5.

Figure 9:
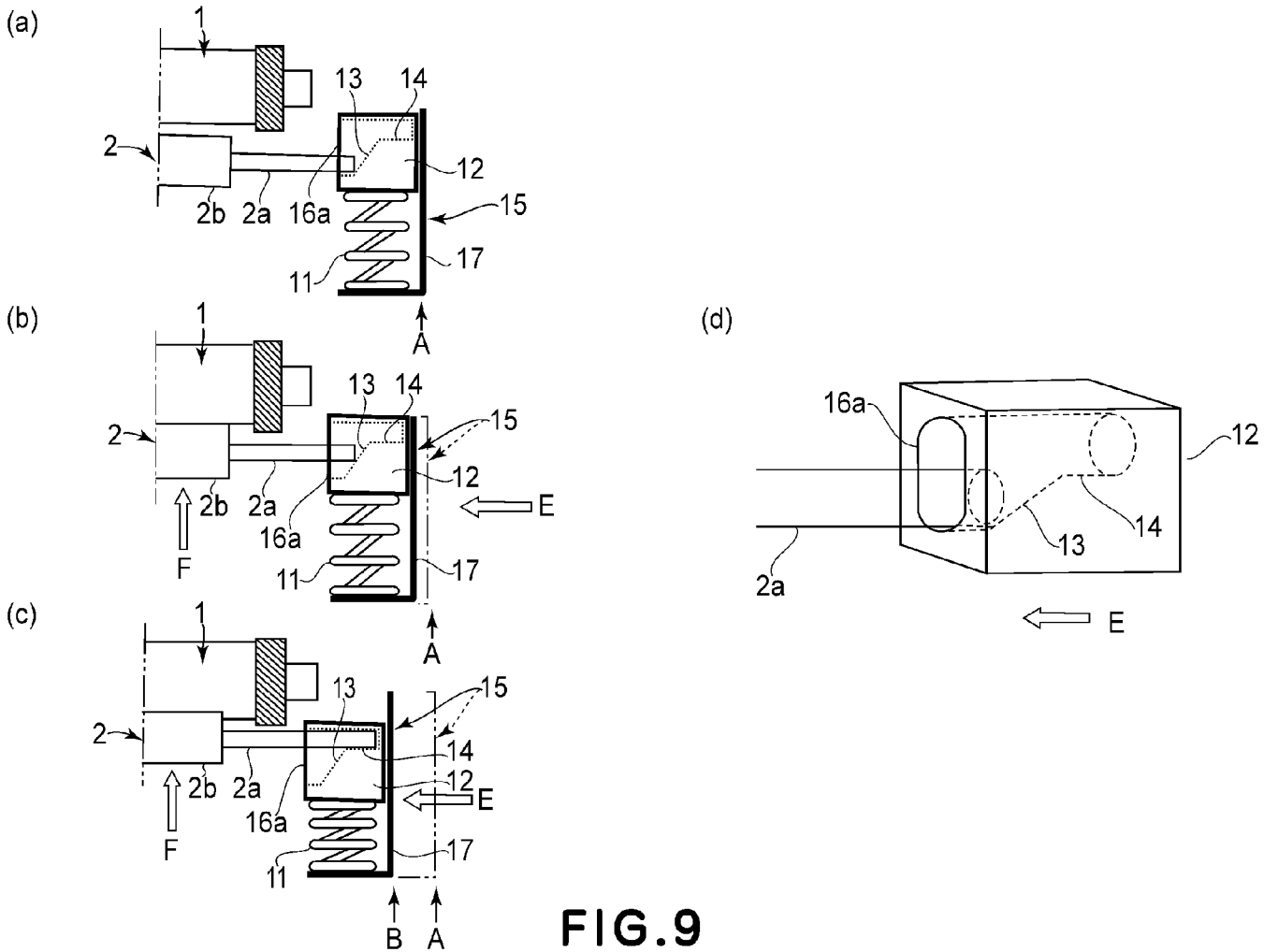

FIG. 9 is an illustration of the supporting device for the charging roller in Embodiment 6 of the present invention.

Figure 10:
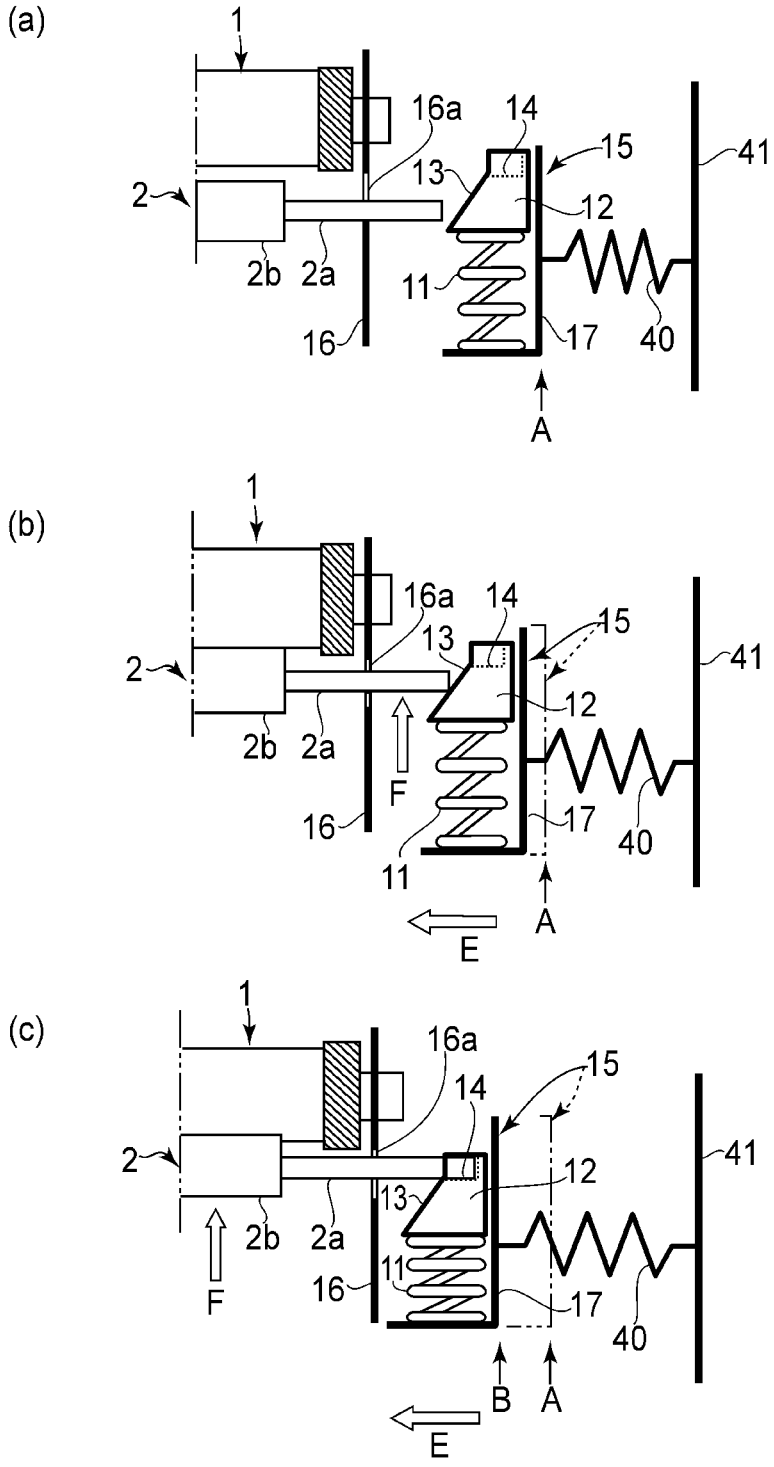

FIG. 10 is an illustration of the supporting device for the charging roller in embodiment 7 of the present invention.

Figure 11:
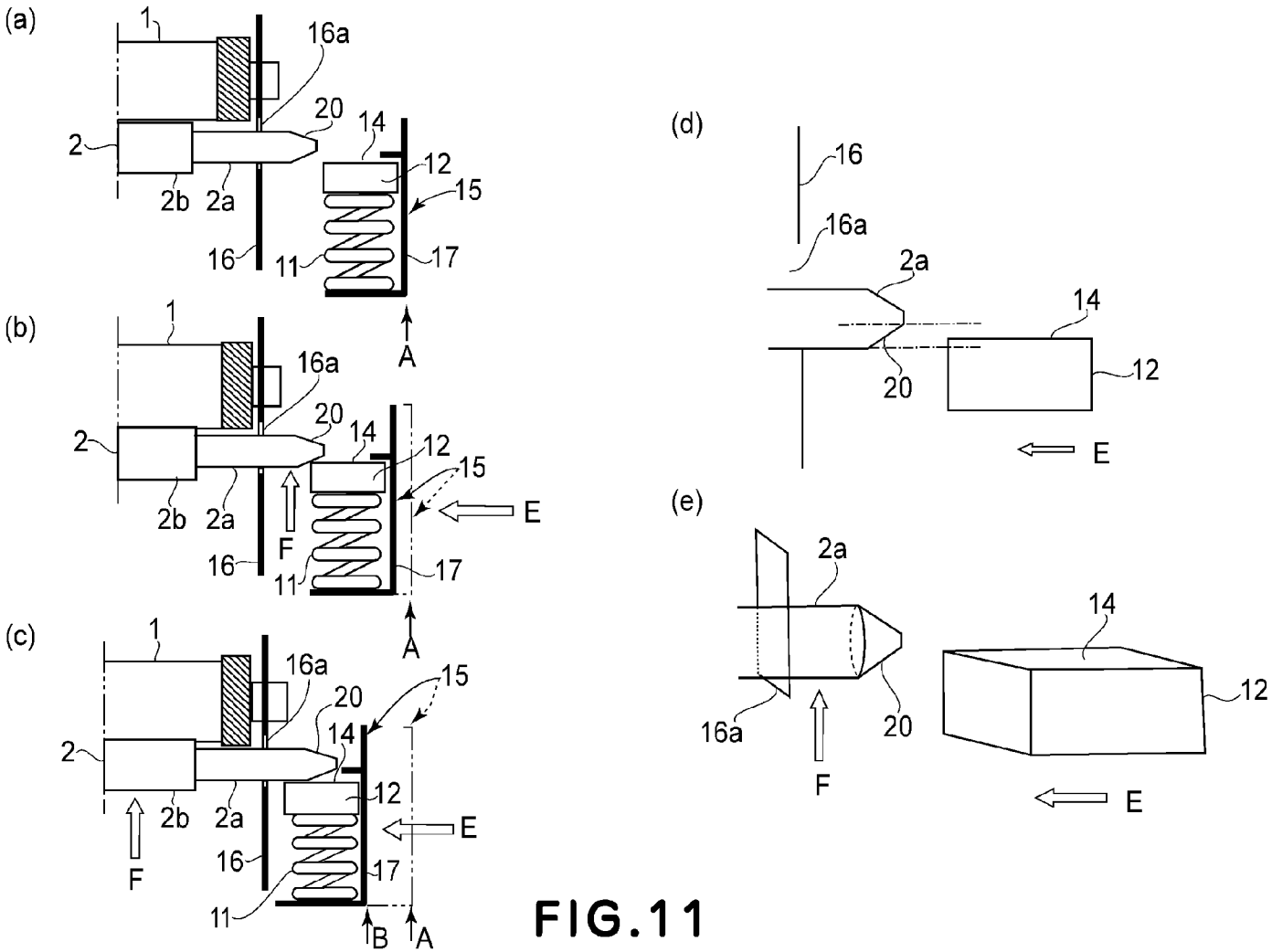

FIG. 11 is an illustration of the supporting device for the charging roller in embodiment 8 of the present invention.

Figure 12:
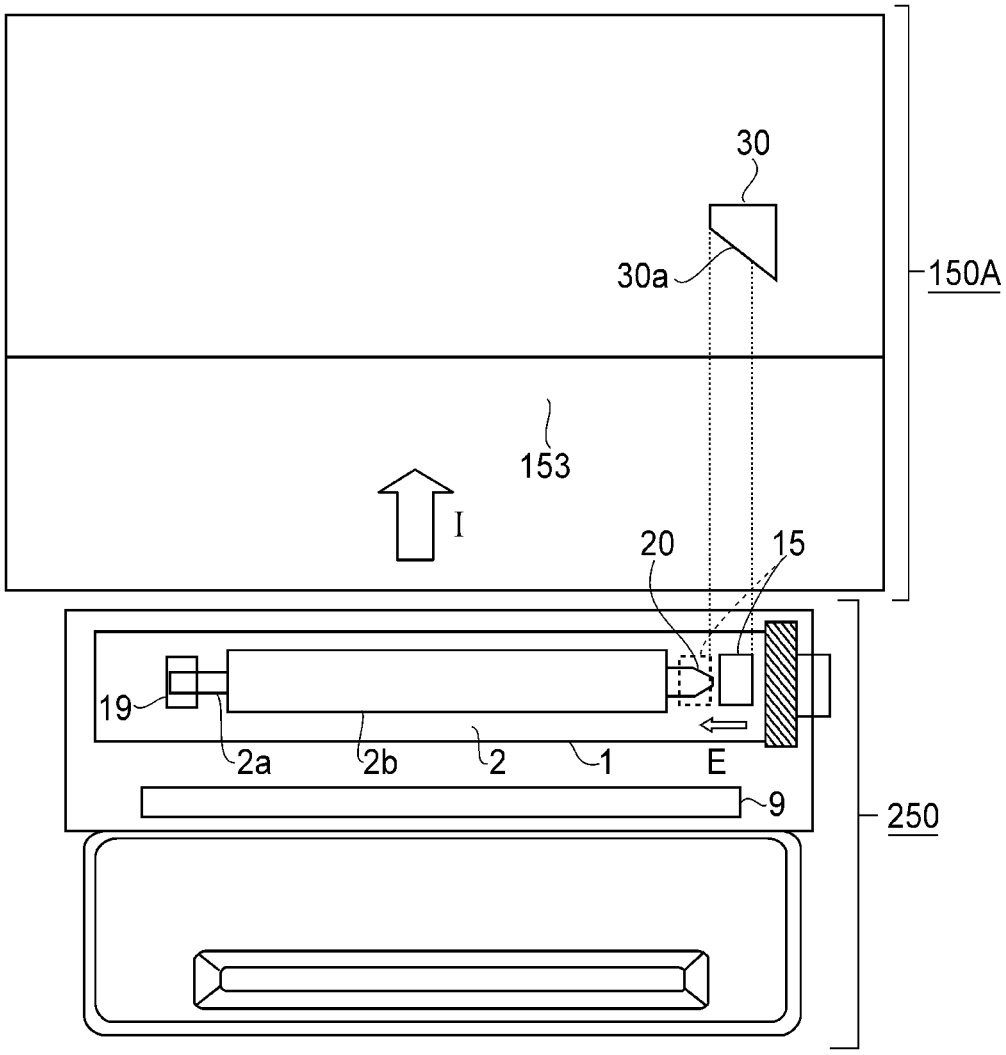

FIG. 12 is an illustration of the supporting device and a movement auxiliary member in Embodiment 8.

Figure 13:
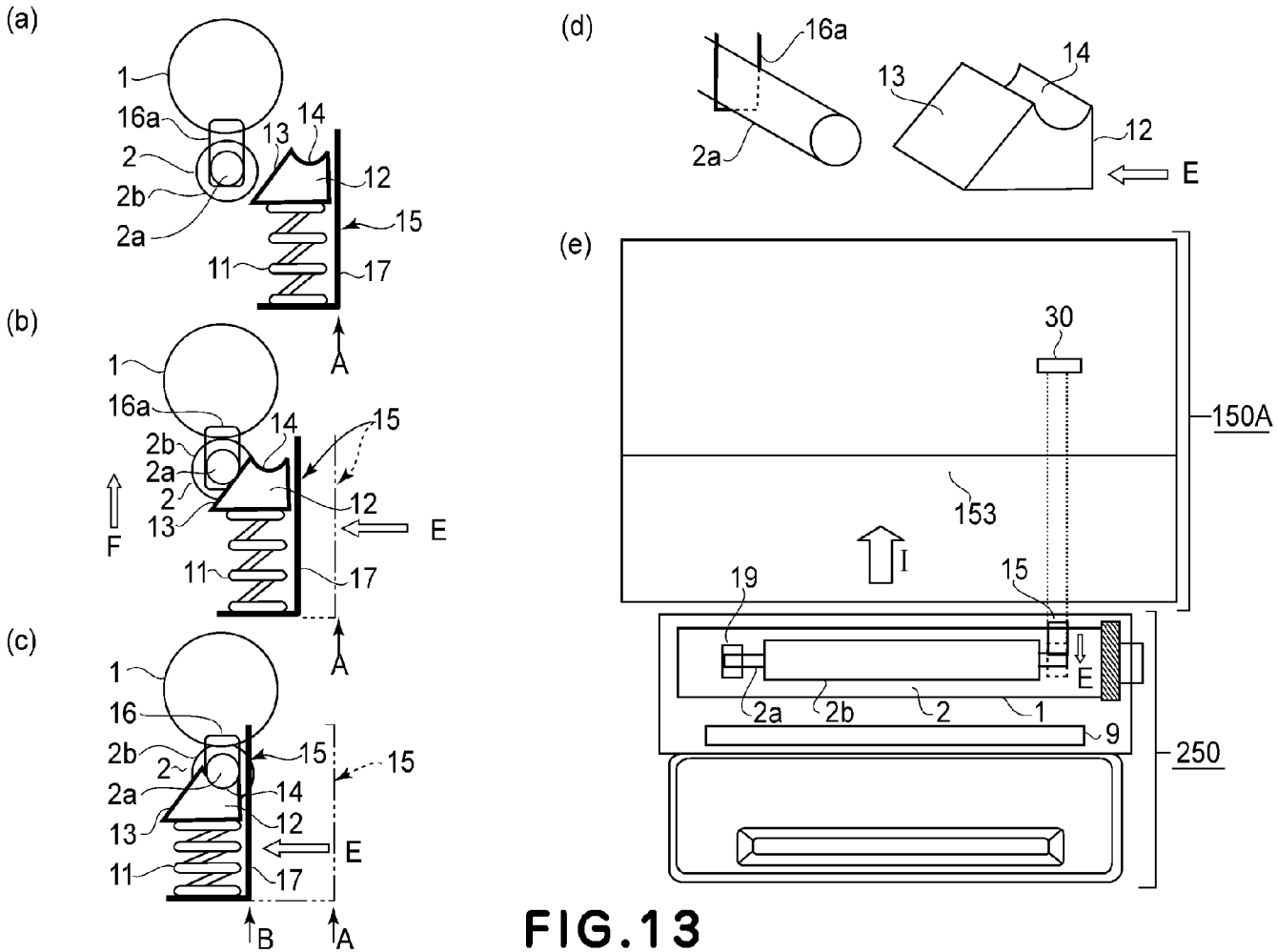

FIG. 13 is an illustration of the supporting device for the charging roller in Embodiment 9 of the present invention.

Figure 14:
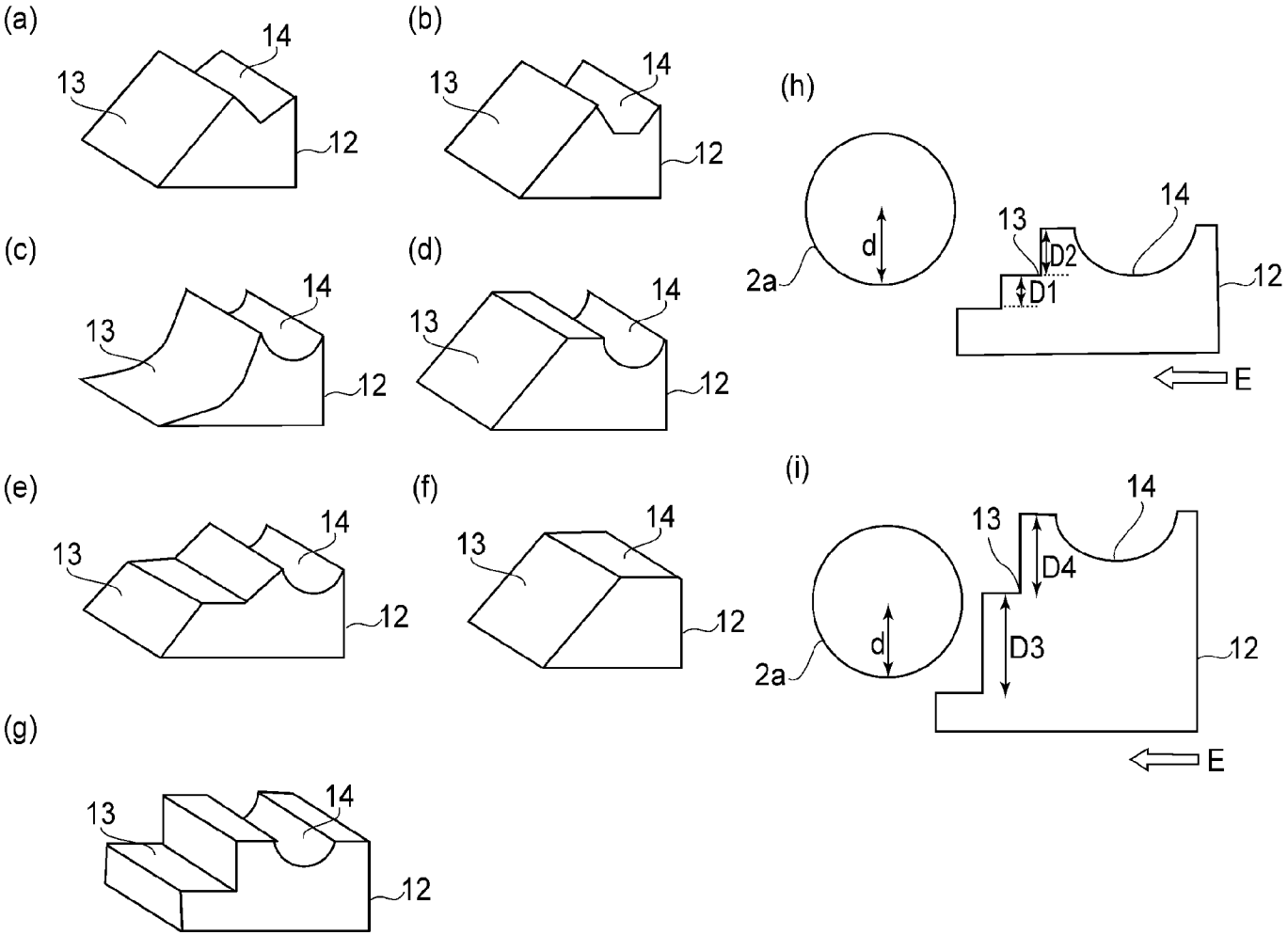

FIG. 14 is an illustration of various examples of a bearing member in Embodiment 9.

Figure 15:
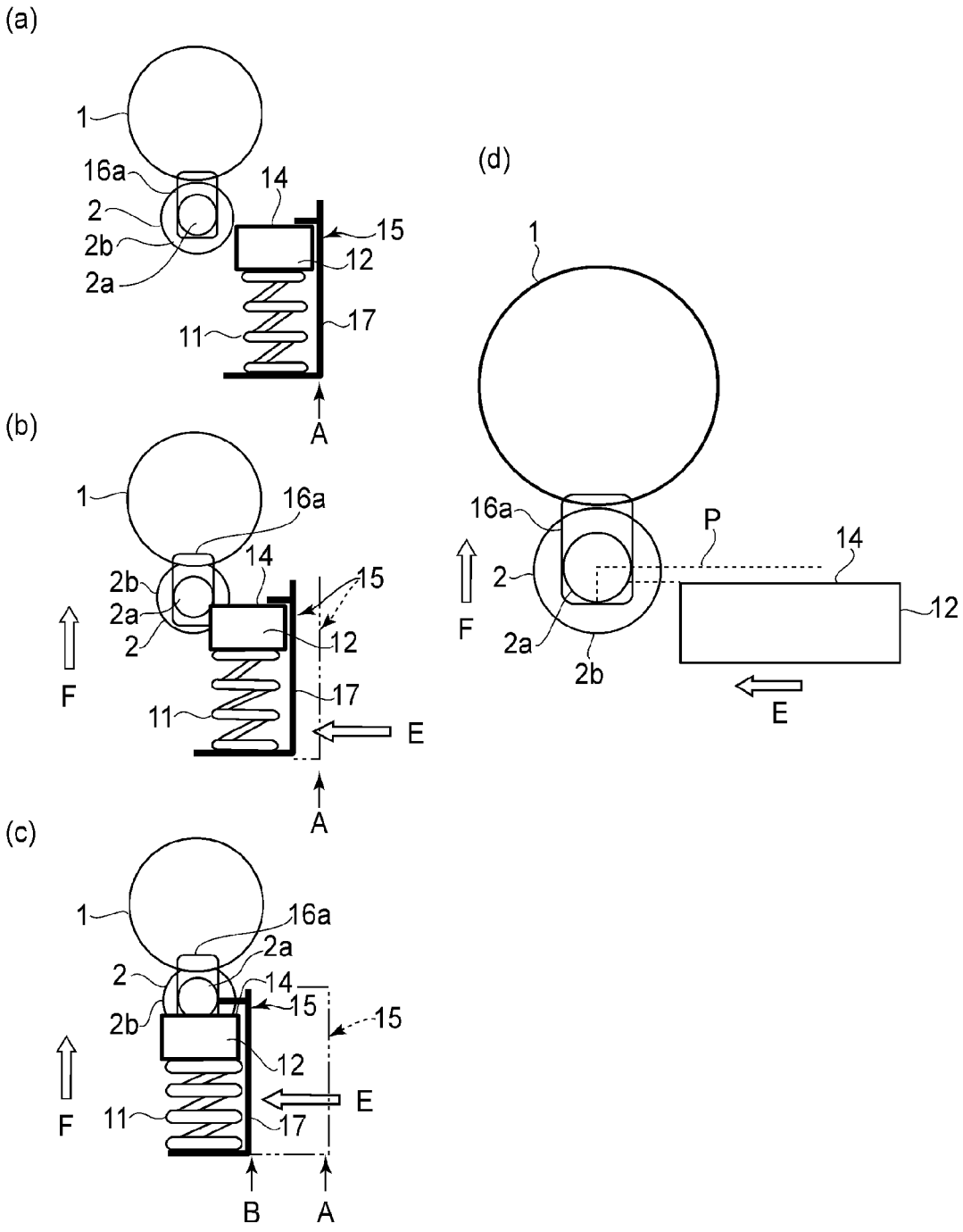

FIG. 15 is an illustration of the supporting device for the charging roller in Embodiment 10 of the present invention.

Figure 16:
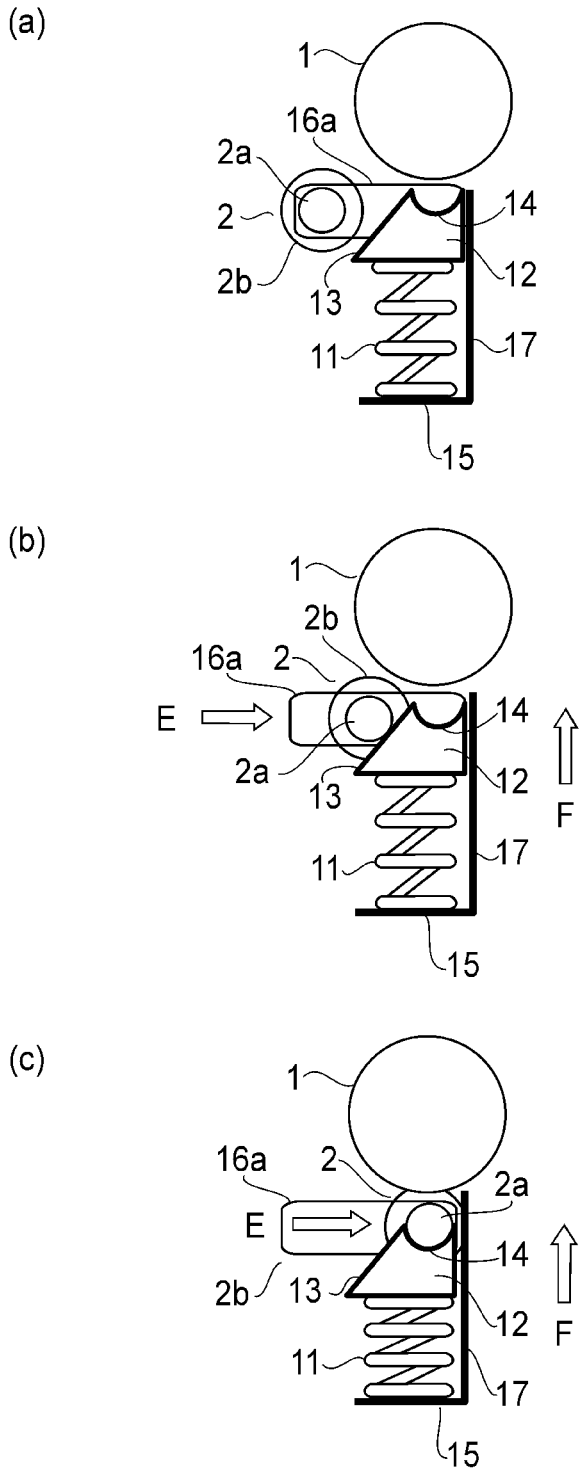

FIG. 16 is an illustration of the supporting device for the charging roller in Embodiment 11 of the present invention.

Figure 17:
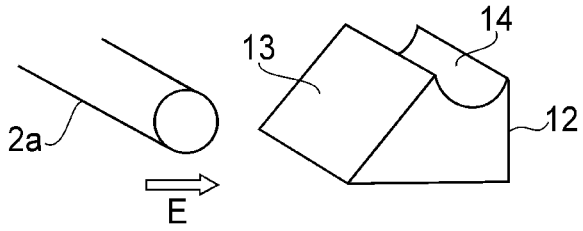
Figure 17:
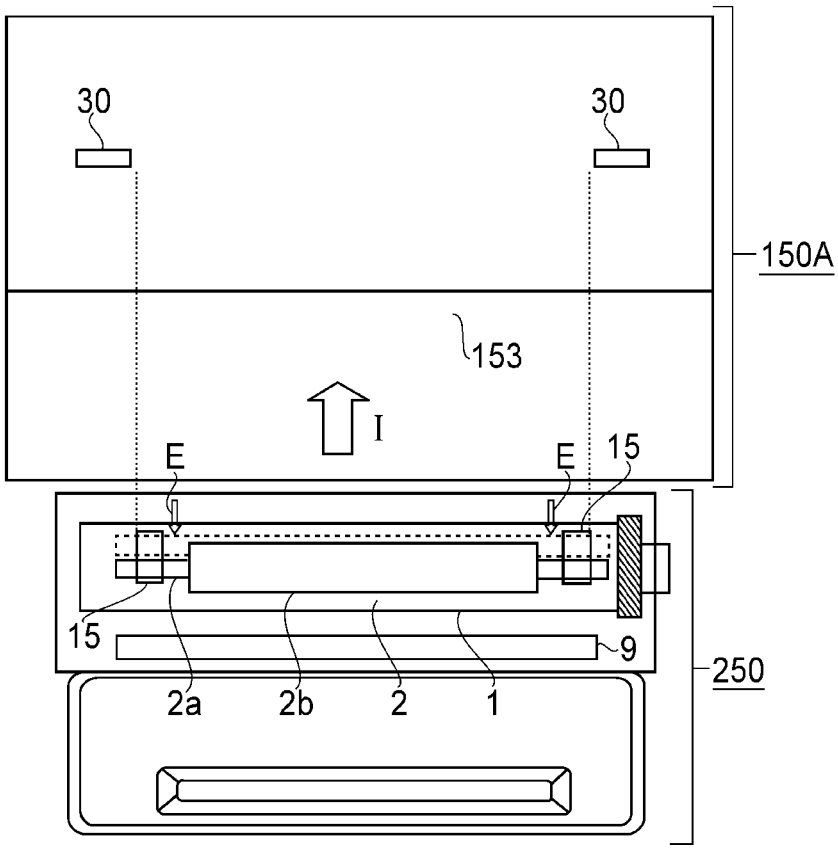

FIG. 17 is an illustration of a shaft and a movement auxiliary member for a charging roller.

Figure 18:
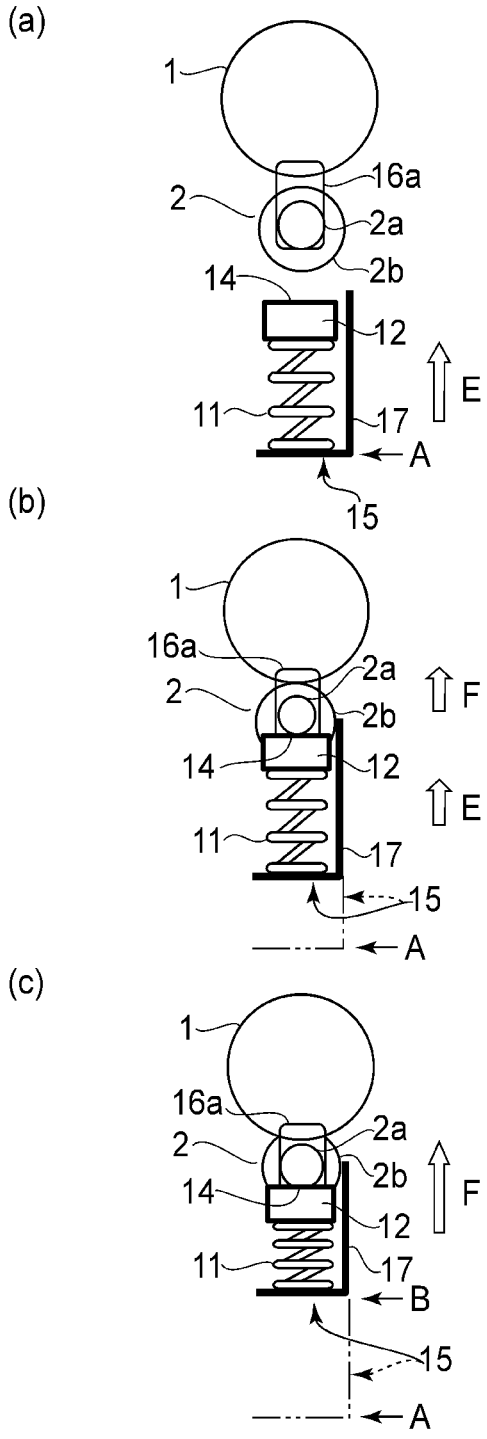

FIG. 18 is an illustration (No. 1) of a supporting device of a charging roller in Embodiment 12.

Figure 19:
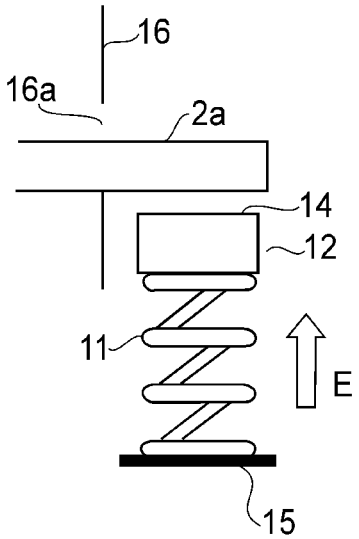
Figure 19:
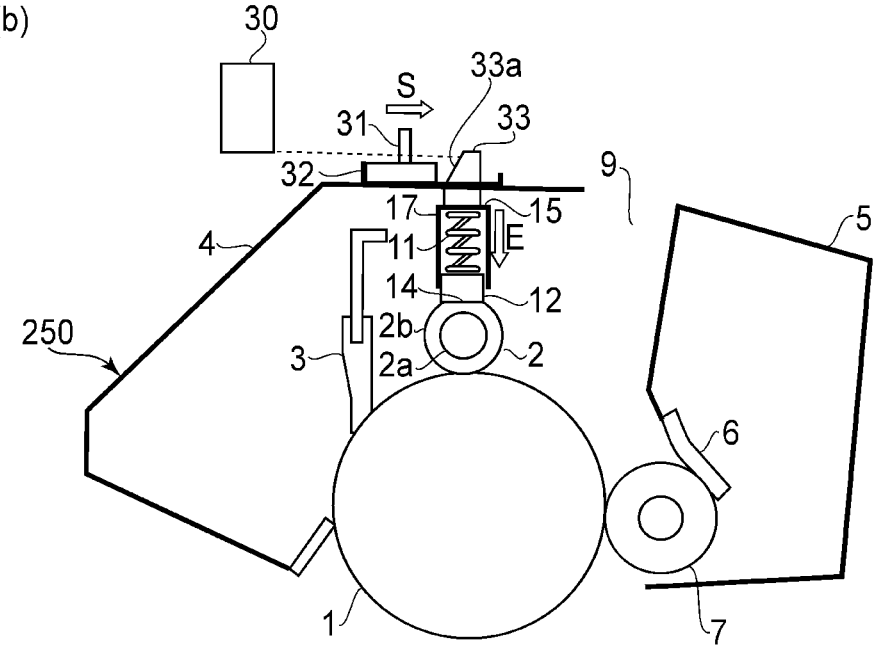

FIG. 19 is an illustration (No. 1) of a supporting device of a charging roller in Embodiment 12 (No. 2).

Figure 20:
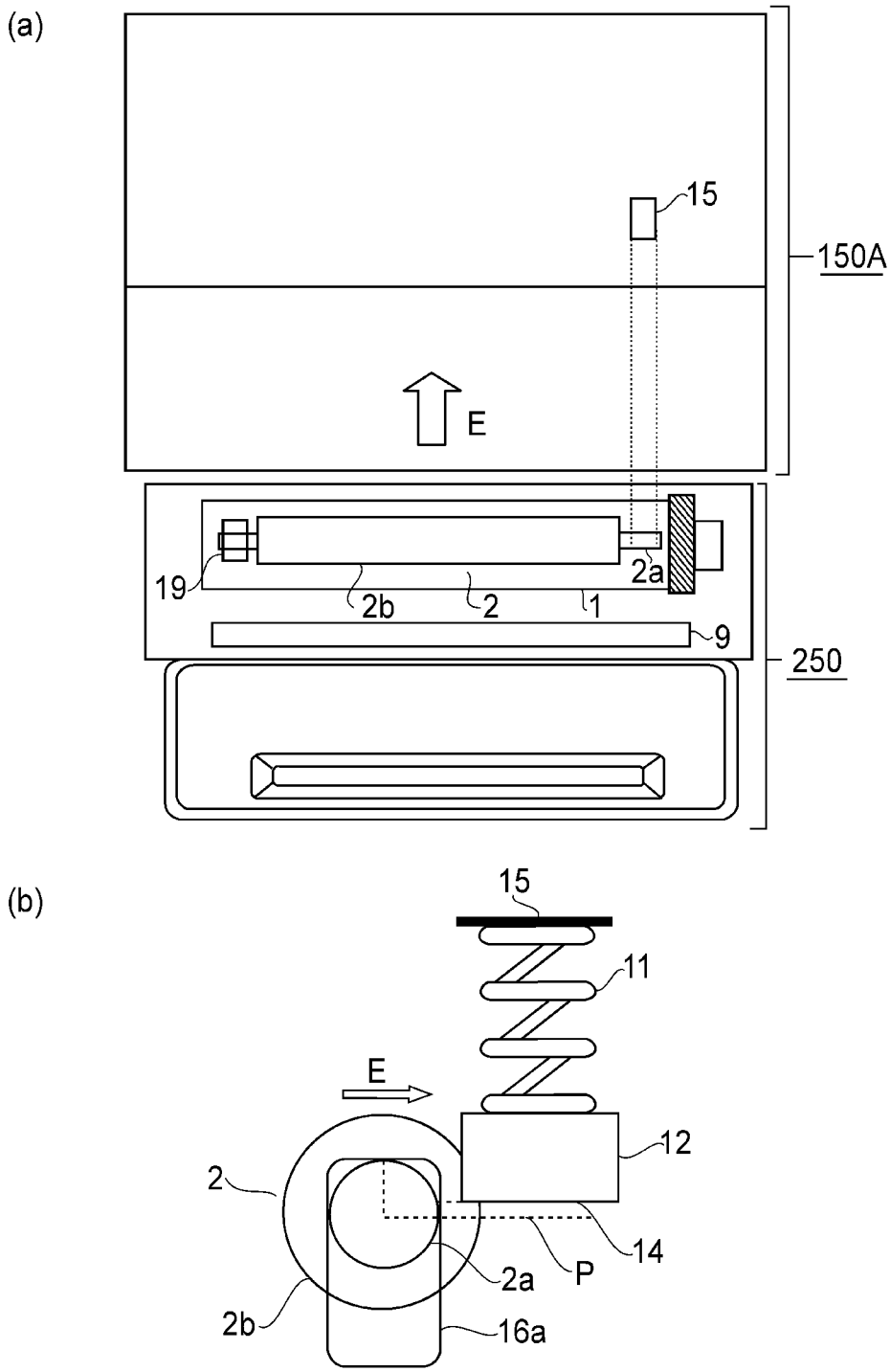

FIG. 20 is an illustration (No. 1) of a supporting device of a charging roller in Embodiment 13 (No. 1).

Figure 21:
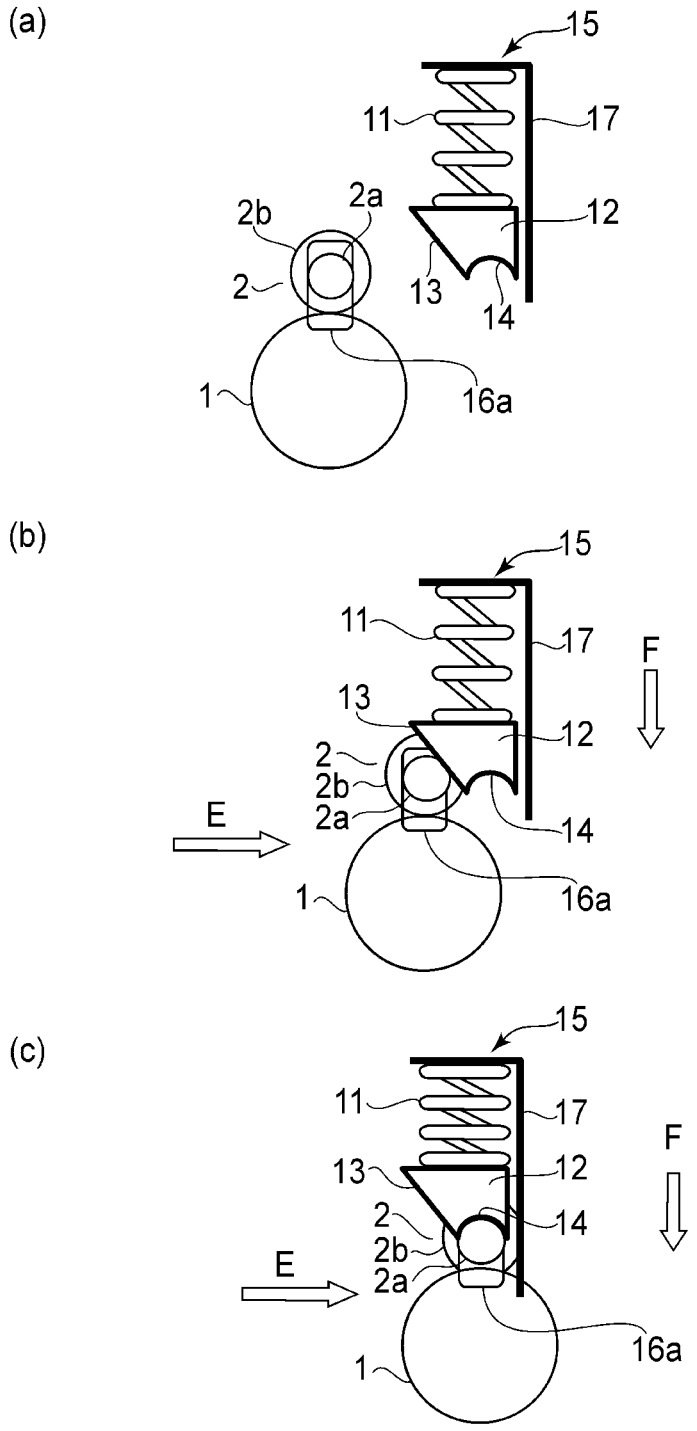

FIG. 21 is an illustration (No. 1) of a supporting device of a charging roller in Embodiment 13.

Figure 22:
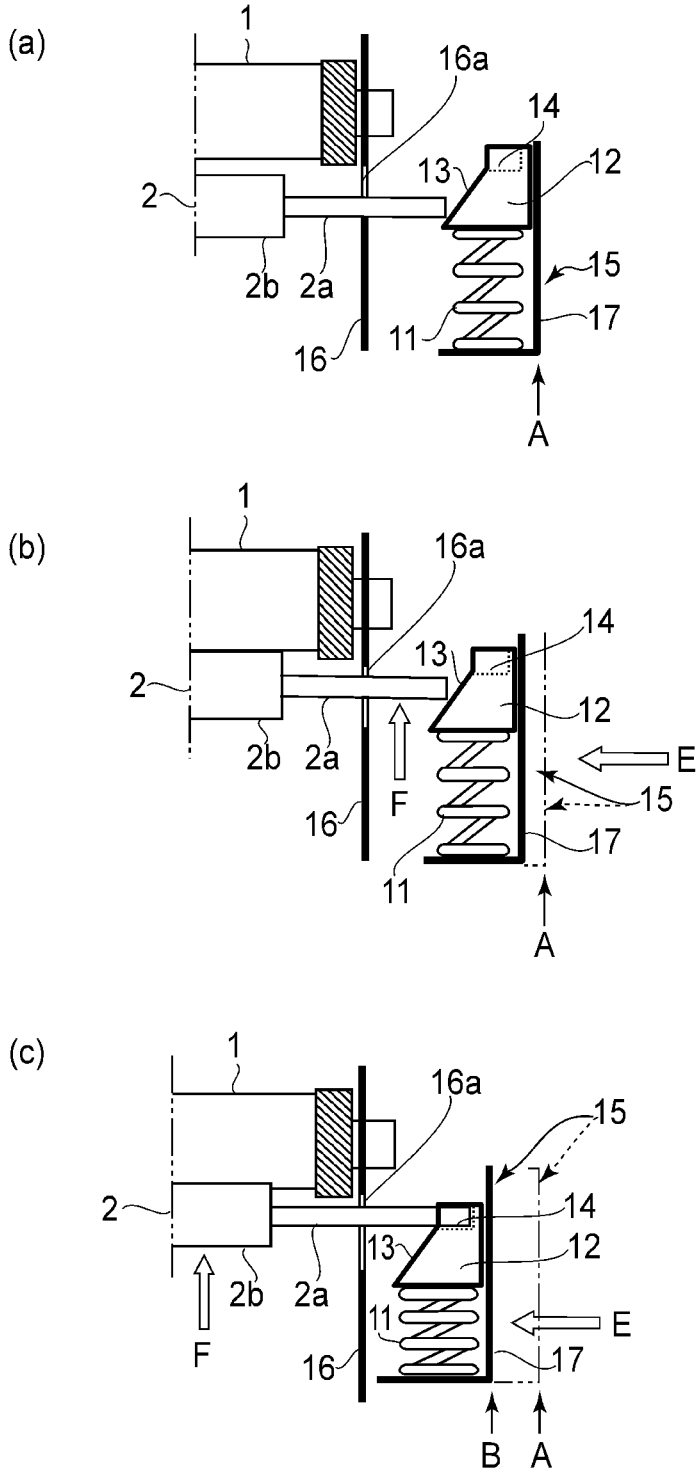

FIG. 22 is an illustration (No. 1) of a supporting device of a charging roller in Embodiment 14.

Figure 23:
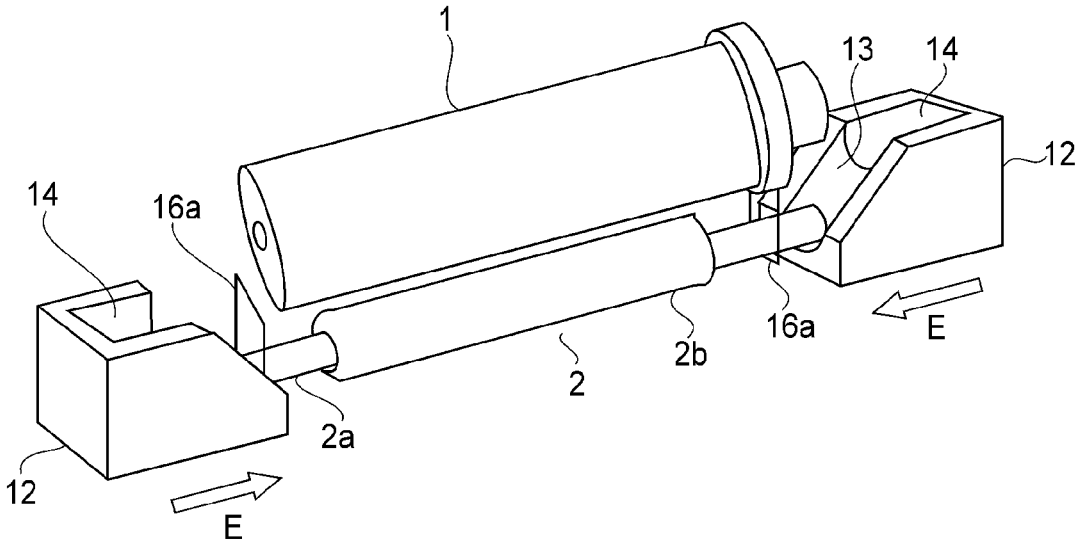

FIG. 23 is an illustration (No. 2) of a supporting device of a charging roller in Embodiment 14.

DESCRIPTION OF THE PREFERRED EMBODIMENTS

Embodiment 1

(1) General Arrangement of Image Forming Apparatus

Figure 1:
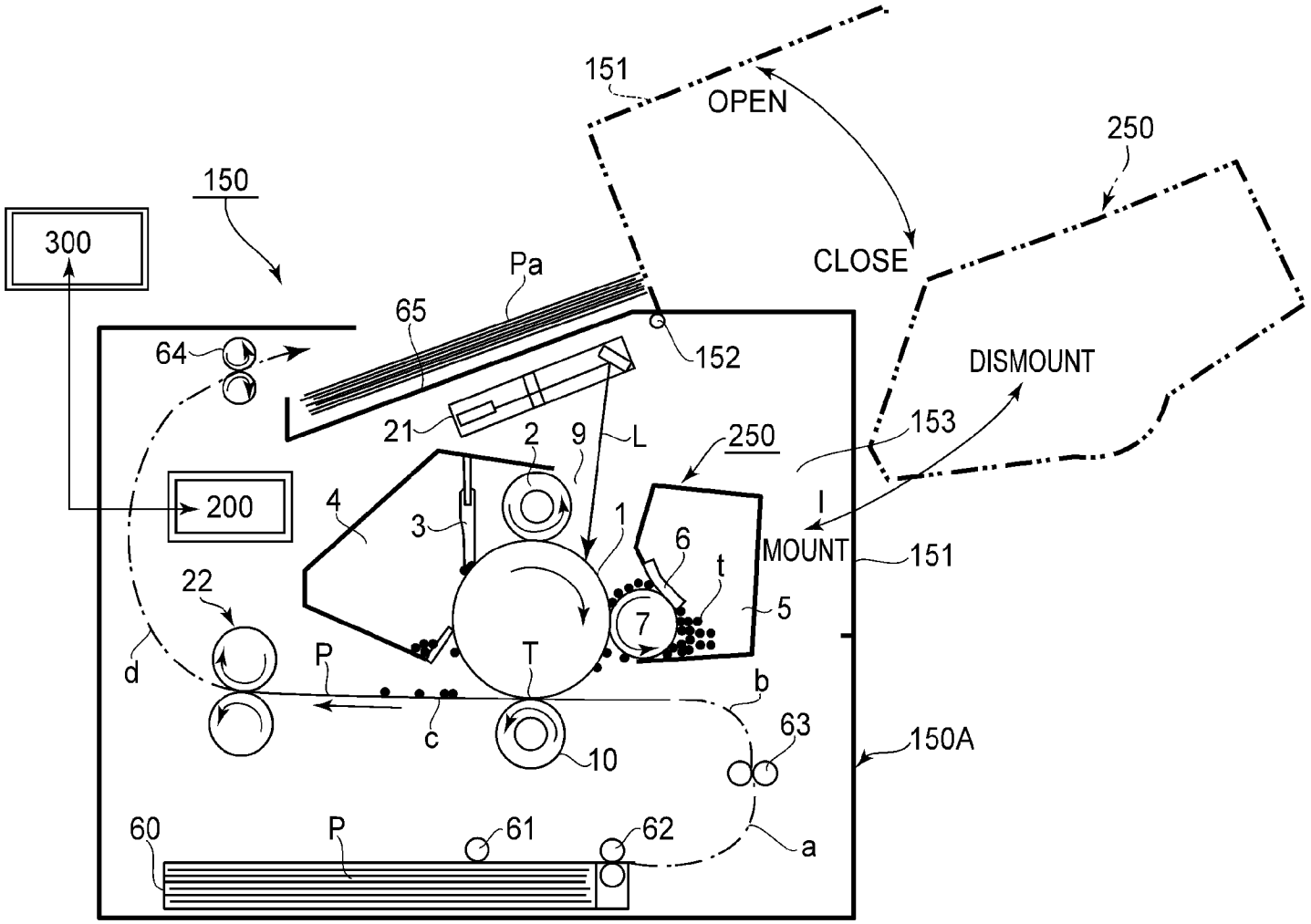
FIG. 1 is a schematic view of an image forming apparatus according to Embodiment 1 of the present invention.

FIG. 1 is a schematic view of an image forming apparatus 150 according to this embodiment.

The apparatus 150 is a laser beam printer of an electrophotographic type, in which a process cartridge (cartridge) 250 is detachably mountable.

It is connected with an external host apparatus 300 and is capable of forming images on recording materials P on the basis of image information inputted from the apparatus 300 to a control circuit portion 200.

The apparatus 300 is an image reading apparatus (image reader), a personal computer (PC), terminal equipment, a word processor, a facsimile machine, for example.

The recording material P is a paper sheet, an OHT sheet, a label, textile or the like on which a toner image can be formed.

A cartridge 250 is detachably mountable to a main assembly 150A of the apparatus and includes an electrophotographic photosensitive member 1 which is a rotatable image bearing member on which the image is formed, and a charging roller 2 as a rotatable member which rotates in contact with the photosensitive member 1 at least during an image forming operation.

The cartridge 250 in this embodiment further includes a cartridge frame, which contains the rotatable drum type electrophotographic photosensitive member (drum) 1 and which contains a charging roller 2, a developing device 5, and a cleaning device 4 which are process means actable on the drum 1.

The charging roller 2 is a contact-type charging means for charging uniformly the drum 1.

The developing device 5 is a developing means for visualizing an electrostatic latent image formed on the drum 1 into a toner image with a developer (toner)

The cleaning device 4 is a cleaning means for cleaning a surface of the drum after toner image transfer.

The main assembly 150A is structural portions of the image forming apparatus 150 excluding the cartridge 250.

The main assembly 150A is provided with an opening and closing cover 151 which is opened by rotation about a hinge portion 152 as indicated by chain lines, by which the cartridge 250 can be mounted to the main assembly.

By opening the cover 151, a cartridge mounting portion 153 inside of the main assembly is exposed.

The mounting portion 153 is provided with a descending (as seen from the outside) cartridge guide portion (unshown).

The user grips the cartridge 250 and inserts it along the cartridge guide portion in a predetermined direction sufficiently to the mounting position of the mounting portion 153.

In the predetermined mounting position, an exposure window portion 9 provided in an upper surface of the cartridge faces the exposure device (exposure means 21 of the main assembly side.

In addition, a lower surface of the drum exposed from a lower surface of the cartridge is contacted to a transfer roller 10 as a contact transfer charging member (transferring means) of the main assembly side.

Then, the cover 151 is closed.

By the cartridge 250 being mounted to the main assembly 150A, the cartridge 250 is connected and coupled with the main assembly side mechanically and electrically.

By this, a driven member (drum, a developing roller, a toner stirring member or the like) in the cartridge side can be driven by an unshown) driving mechanism in the main assembly side.

Sensors of the cartridge side are connected with the control circuit portion 200 of the main assembly side.

In addition, a charging roller, the developing roller or the like of the cartridge side can be supplied with predetermined bias voltages from an unshown voltage source portion of the main assembly side.

The cartridge 250 is dismounted from the main assembly 150A through the steps in the order opposite from that in the case of the mounting operation.

More particularly, in FIG. 1, the cover 151 is opened, and the cartridge 250 is drawn toward the upper right, and then the cartridge 250 is removed along the cartridge guide portion to the outside of the main assembly 150A.

The control circuit portion 200 sends and receives information to and from the host apparatus 300 to control image formation sequences of the apparatus 150.

The control circuit portion 200 executes the image formation of the apparatus 150 in response to a print starting signal.

More particularly, it starts an unshown driving motor to rotate the drum 1 in the clockwise direction indicated by an arrow at a predetermined speed.

A peripheral surface of the rotated drum 1 is charged uniformly to a predetermined polarity and potential by the charging roller 2.

The charging roller 2 comprises a core metal (shaft) and an elastic electroconductive member thereon, and the opposite ends of the core metal are supported rotatably, wherein the elastic electroconductive member is press-contacted to the outer surface of the drum 1 with a predetermined urging force, and the charging roller 2 is rotated by the rotation of the drum 1.

The charging roller 2 is supplied with a predetermined charging bias voltage from the voltage source portion of the main assembly side through the core metal.

By this, the outer surface of the rotating drum 1 is contact-charged uniformly to the predetermined polarity and potential.

In this example, the drum 1 is charged to the predetermined potential of the negative polarity.

The charged surface of the drum 1 is exposed to image light by an exposure device 21.

The exposure device 21 of this embodiment uses a semiconductor laser scanner.

The exposure device 21 outputs laser beam modulated in accordance with an image signal inputted from the control circuit portion 200.

The image light enters the cartridge through the exposure window 9 of the cartridge 250 and scans the charged surface of the drum 1 (image exposure).

An absolute value of the potential of the exposed portion of the surface of the drum 1 becomes lower than an absolute value of the charged potential, so that an electrostatic latent image in accordance with the image information is formed sequentially.

The electrostatic latent image is visualized into a toner image by development with the toner (developer) t in the developing device 5.

In this embodiment, the use is made with a contact-type developing system in which the developing roller 7 is contacted to the drum 1 at a predetermined pressure.

In such a type, a predetermined developing bias voltage is applied to the developing roller 7 which is a developing member from a voltage source portion (unshown)

The toner t charged triboelectrically at a contact position between a developer layer thickness regulating member 6 and the developing roller 7 is applied to the electrostatic latent image on the surface of the drum 1 to effect reverse development.

On the other hand, the control circuit portion 200 rotates a pick-up roller 61 and a sheet feeding roller 62 of a sheet feeding cassette 60 at predetermined control timing.

By this, the recording materials P stacked in the sheet feeding cassette 60 are separated and fed one by one.

The recording material P is fed along a sheet path a and reaches a pair of registration rollers 63 which is on/off controlled at predetermined control timing.

The roller pair 63 which is not rotating temporally stops a free end of the recording material P to correct inclination of the recording material P.

The roller pair 63 starts to rotate at predetermined control timing, so that the recording material P is introduced to a transfer portion T which is a contact nip between the drum 1 and the transfer roller 10 through a sheet path b.

The recording material P is fed to the transfer portion T in synchronism with image formation on the drum 1 by the roller pair 63.

The transfer roller 10 comprises a core metal (shaft) and an elastic electroconductive member thereon, and the opposite ends of the core metal are supported rotatably, wherein the elastic electroconductive member is press-contacted toward a center of the drum 1 to the surface of the drum 1 by an unshown urging spring at a predetermined urging force.

When the recording material P is nipped and fed through the transfer portion T, an image transfer bias voltage of a predetermined potential of a polarity opposite from the charge polarity of the toner is applied to the transfer roller 10 from the voltage source portion (unshown).

By this, the toner image on the surface of the drum 1 is electrostatically transferred sequentially onto the surface of the recording material P.

The recording material P having the transferred toner image is separated from the drum surface and is fed to a fixing device 22 along a sheet path c and is subjected to a fixing process.

The fixing device 22 fixes the toner image on the recording material P by heat and/or pressure into a fixed image.

The recording material P having passed through the fixing device 22 is discharged by sheet discharging rollers 64 along a sheet path d to a sheet discharge tray 65 as a print Pa.

The surface of the drum 1 after the toner image is transferred onto the recording material P is cleaned by scraping the untransferred toner by the cleaning device 4 so as to be used for repeated image formation.

The cleaning device 4 includes a cleaning blade 3 which extends along the length of the drum 1 and which is contacted to the drum 1 at a predetermined pressure counterdirectionally relative to the rotational moving direction of the drum to remove the untransferred toner.

By this, the surface of the drum 1 is cleaned.

After completion of the cleaning process, the surface of the drum 1 is subjected to the charging Step.

In this manner, the apparatus 150 carries out the repeated image formation through the charging, exposure, developing, transferring, fixing and cleaning steps using said means.

(2) Cartridge 250

In the following description of the preferred embodiments of the present invention, the lengthwise direction of the cartridge 250 is such that is parallel to the axial line of the drum 1. Thus, the ends of the cartridge 250 are the lengthwise ends of the cartridge 250. Next, referring to FIG. 2, the structural relationship between the drum 1 and cartridge frame, and the structural relationship between the charging roller 2 and cartridge frame, are described. In order to make FIG. 2 easier to see the components related to the present invention, the cartridge frame is not shown in FIG. 2. The drum 1 is rotatably supported by the cartridge frame. More specifically, one end of the drum 1 is supported by a bearing with which the corresponding wall of the cartridge frame is provided, and the other end of the drum 1 is supported with a bearing with which the corresponding wall of the cartridge frame is provided. The charging roller 2 is a rotatable roller. It is kept pressed upon the peripheral surface of the drum 1 by a preset amount of pressure at least during an image forming operation. It is made up of a core 2*a* (shaft) and a surface layer 2*b*. The core 2*a* is made of a metallic substance. The surface layer 2*a* is an electrically conductive and elastic layer (formed of electrically conductive rubber, for example), and covers virtually the entirety of the peripheral surface of the metallic core 2*a*. The cartridge 250 is structured so that the charging roller 2 can be kept in two different states in terms of its positional relationship relative to the drum 1, by being placed in two different positions, that is, a position in which it is not kept pressed upon the drum 1 by a mechanism for changing the state of the charging roller 2 as shown in FIG. 2(*a*), and another position in which it is kept pressed upon the drum 1 by the mechanism.

Hereinafter, the above-mentioned charging roller state changing mechanism is described in detail. In this embodiment, one end (which hereafter is referred to as first end) of the metallic core 2*a* corresponds to a supporting device 15, and the other (which hereafter is referred to as second end) corresponds to a bearing apparatus 19. The supporting device 15 and bearing apparatus 19 are attached to the cartridge frame. The first end portions of the metallic core 2*a* are put through a pair of guiding portions 16*a* of an auxiliary frame 16, one for one. Thus, the first end of the metallic core 2*a* is outside the auxiliary frame 16 of the cartridge frame. The auxiliary frame 16 is an integral part of the cartridge frame. Referring to FIG. 2(*c*), the guiding portion 16*a* is an elongated hole, by the edge of which the metallic core 2*a* is guided in such a manner that each of the lengthwise ends of the metallic core 2*a* moves toward, or away from, the drum 1. That is, the guiding portion 16*a* is for allowing the charging roller 2 to move toward, or away from, the drum 1, within a preset range g1. The supporting device 15 is attached to the cartridge frame, and is on the outward side of the auxiliary frame 16. It has the following portions 12, 17, and 11. That is, the supporting device 15 has a bearing 12, a bearing guiding member 17, and a pressure applying member 11. The bearing 12 has a charging roller holding portion 14, and a metallic core guiding portion 13. The charging roller holding portion 14 holds the charging roller 2 by the first end portion of the metallic core 2*a* in such a manner that the charging roller 2 is kept pressed upon the drum 1. The guiding portion 13 guides the first end of the metallic core 2*a* into the charging roller supporting portion 14. The guiding member 17 supports the bearing 12 in such a manner that the bearing 12 is allowed to slide in the direction indicated by an arrow F, that is, the direction to make the entirety of the charging roller 2 come into contact with the drum 1. The pressure applying member 11 is between the bearing 12 and bearing guiding member 17, and keeps the bearing 12 pressed in the direction of the arrow F. The metallic core 2*a* is supported by the supporting device 15 in such a manner that the first end portion of the metallic core 2*a* is allowed to move roughly in the same direction as the direction in which the bearing 12 is kept pressed by the pressure applying member 11, within the aforementioned range g1 (lengthwise dimension of elongated hole of guiding portion 16*a*). The supporting device 15 is allowed to move between its inactive position A (second position) and its active position B (first position), in the direction parallel to the axial line of the charging roller 2. The inactive position A (second position) is a preset distance away from the charging roller 2 in terms of the lengthwise direction of the charging roller 2. The active position B is a preset distance closer to the charging roller 2 than the position A in terms of the lengthwise direction. Further, the cartridge 250 is structured so that the supporting device 15 is slidable relative to the cartridge frame, being thereby enabled to be placed in the aforementioned inactive position A or active position B. An arrow E indicates the direction in which the supporting device 15 is moved from its inactive position A to its active position B.

Figure 2:
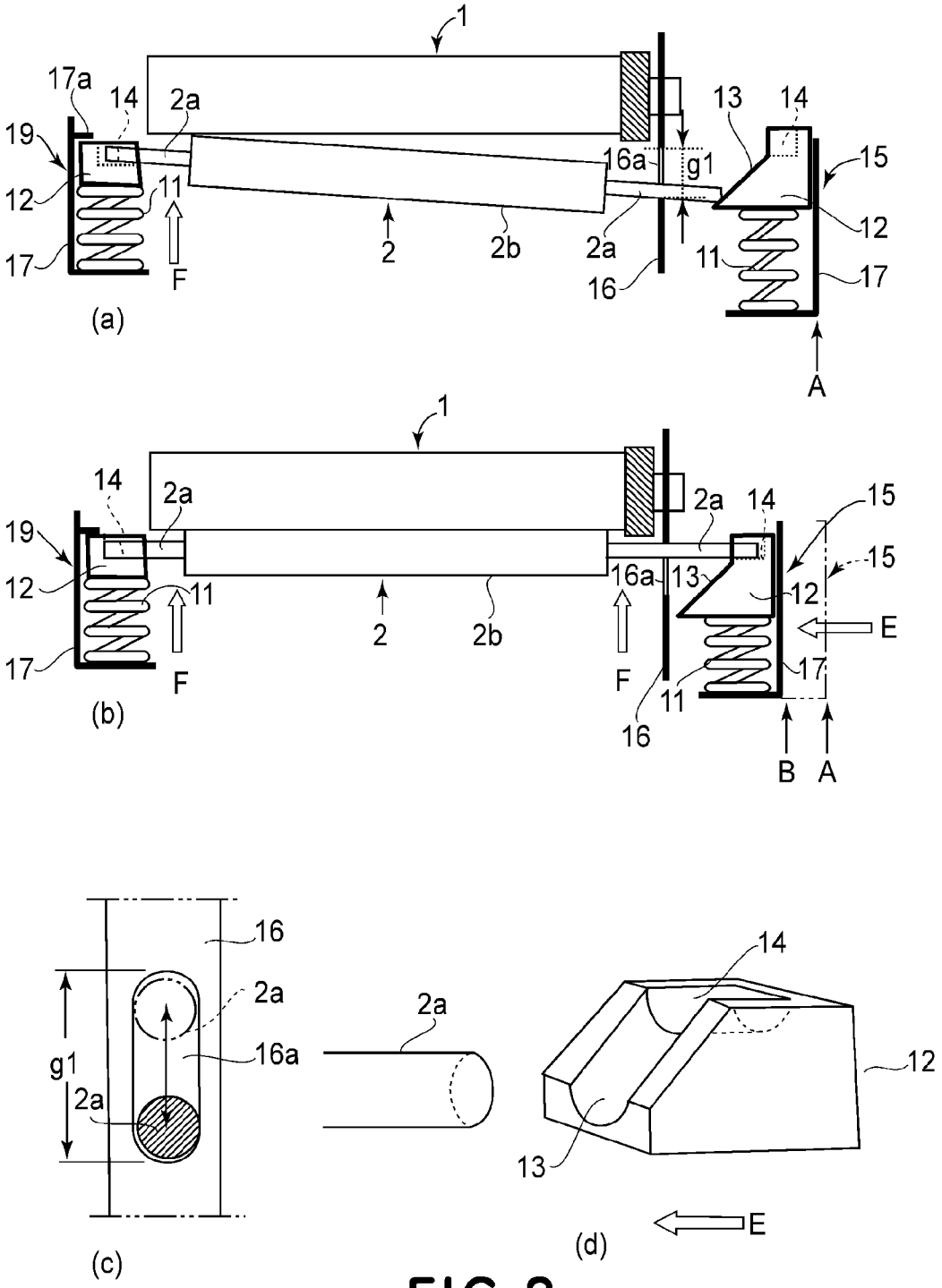
FIG. 2 is an illustration of a supporting device and a bearing device for a charging roller in Embodiment 1.

Referring to FIG. 2(*d*), the bearing 12 has a metallic core guiding portion 13 for smoothly guiding the charging roller 2 by the first end of the metallic core 2*a*. The metallic core guiding portion 13 is a semi-cylindrical groove, the shape (cross-section) of which matches that of the metallic core 2*a*. It is tilted relative to the top and bottom surface of the bearing 12. The bearing 12 has also the charging roller holding portion 14, which also is a semi-cylindrical groove with a smooth surface. The holding portion 14 is slightly larger in curvature than that of the metallic core 2*a*, being thereby enabled to reliably support the charging roller 2 by the first end portion of the metallic core 2*a*, in a preset position. Because the bearing 12 is provided with the guiding portion 13, it can reliably and efficiently guide the metallic core 2*a* into the metallic core holding portion 14. That is, providing the bearing 12 with the guiding portion 13 makes it possible for the bearing 12 to smoothly (efficiently) and reliably guide the metallic core 2*a* into the holding portion 14, and reduces the metallic core 2*a* and bearing 12 in frictional wear. It also reduces the amount of resistance to which a user is subjected when the user inserts the cartridge 250 into the main assembly of the image forming apparatus. Thus, it improves the image forming apparatus and cartridge 250 in operability.

The charging roller bearing apparatus 19, which supports the charging roller 2 at the second end, also has a bearing 12, which has a metallic core holding portion 14, a guiding member 17, and a pressure applying member 11. The metallic core holding portion 14 holds the charging roller 2 by the second end portion of the metallic core 2*a* in such a manner that the charging roller 2 is kept pressed upon the drum 1. The guiding member 17 supports the bearing 12 in such a manner that the bearing member 12 is allowed to slide in the direction indicated by the arrow F, that is, the direction to make the entirety of the charging roller 2 come into contact with the drum 1. The pressure applying member 11 is between the bearing 12 and bearing guiding member 17, and keeps the bearing 12 pressed in the direction of the arrow F. The bearing guiding portion of this charging roller bearing apparatus 19 is solidly attached to a preset position of the cartridge frame. That is, the charging roller bearing apparatus 19 is different from the charging roller supporting device 15 in that unlike the apparatus 15, it is not movable relative to the cartridge frame.

When the cartridge 250 is shipped out of a factory, the supporting device 15 is in its inactive position A as shown in FIG. 2(*a*); the supporting device 15 has been moved to the inactive position A in the factory prior to the shipment. When the supporting device 15 is in the inactive position A, the first end portion of the metallic core 2*a* is not supported by the supporting portion 14 of the bearing 12, and is not being pressured toward the drum 1 by the pressure applying member 11. That is, the first end portion of the metallic core 2*a* is borne by the bearing 12 in such a manner that it is within the preset range (g1) of the guiding portion 16*a*. Therefore, the first end portion of the charging roller 2 is neither kept pressed upon the drum 1, nor in contact with the drum 1. The other (second) end portion of the metallic core 2*a* is borne by the bearing 12 of the bearing apparatus 19, but, the bearing 12 is in contact with the stopper portion 17*a*, being prevented from being moved further toward the drum 1. Therefore, even though the second end portion of the elastic layer 2*b* of the charging roller 2 is in contact with the peripheral surface of the drum 1, the contact pressure between the charging roller 2 and drum 1 is relatively small. That is, the charging roller 2 is not kept pressed upon the drum 1 by the preset amount of pressure generated by the pressure applying member 11. That is, when the cartridge 250 is shipped out of the factory, and is on its way to a user, the bearing apparatus 19 is in the inactive position A, and therefore, the charging roller 2 remains in contact with the drum 1 with the presence of a substantially smaller amount of contact pressure between the charging roller 2 and drum 1 compared to that during an image forming operation, or remains separated from the drum 1, that is, with the presence of no contact pressure. Therefore, the combination of the process cartridge and an image forming apparatus in this embodiment is significantly smaller in the amount by which the portion of the charging roller 2, which is in contact with the drum 1 deforms because it is kept pressed upon the drum 1 for a long period of time, that is, during the period in which the cartridge 250 is shipped out of the factory, distributed, and/or kept in storage by a user until it is used, than any combination of a process cartridge and an image forming apparatus in accordance with the prior art. Therefore, it is more reliable in terms of image quality.

In this embodiment, as a user inserts the cartridge 250, in which the charging roller 2 is not kept pressed upon the drum 1 as shown in FIG. 2(*a*), into a cartridge chamber 153 of the main assembly 150A of the image forming apparatus, the state of the charging roller 2 in the cartridge 250 changed to a state in which it is kept pressed upon the drum 1 as shown in FIG. 2(*b*). Next, this change in the state of the charging roller 2 is described with reference to FIGS. 3 and 4.

Figure 3:
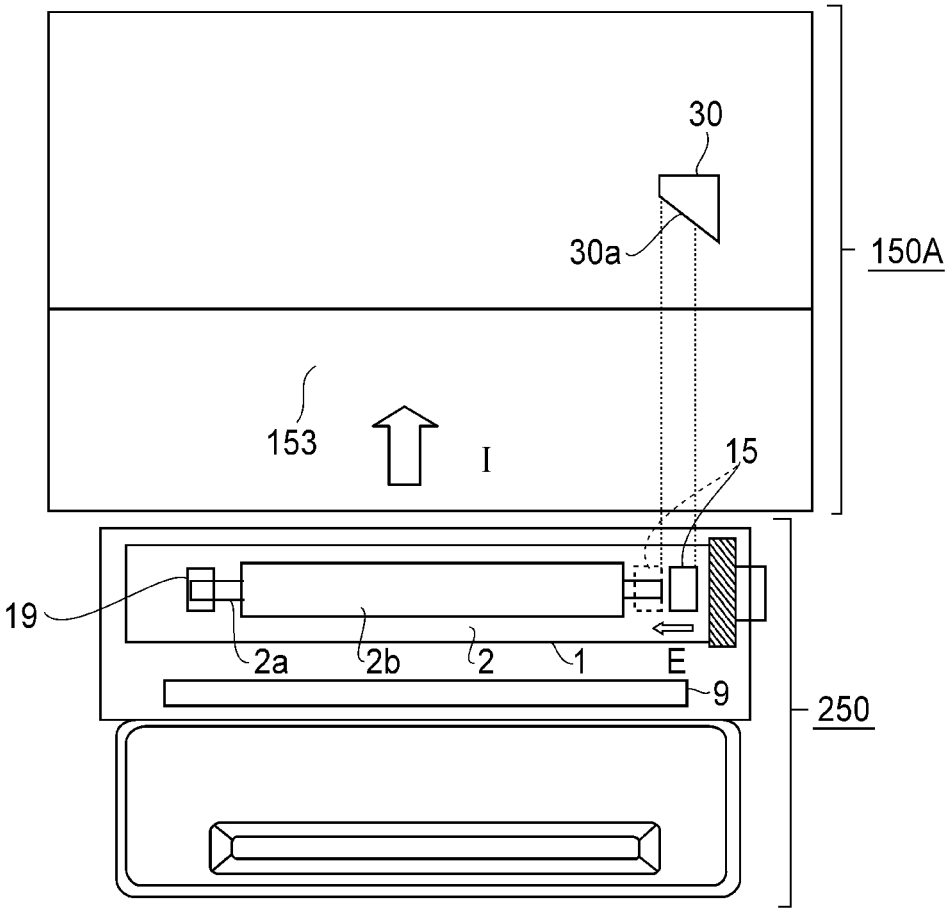
FIG. 3 is an illustration of the supporting device and a movement auxiliary member in Embodiment 1.

1) Referring to FIG. 3, the cartridge 250 is inserted into the cartridge chamber 250 of the apparatus main assembly 150A in the direction indicated by an arrow I, from the cleaning apparatus side of the cartridge 250 (FIG. 1). The direction of the arrow I, that is, the direction in which the cartridge 250 is to be mounted into the apparatus main assembly 150A, is roughly perpendicular to the axial line of the charging roller 2 after the mounting of the cartridge 250 into the apparatus main assembly 150A.

2) When the cartridge 250 is in a slightly upstream position from the preset final position (image formation position), that is, the position beyond which the cartridge 250 cannot be inserted, the supporting device 15, which has been kept in the inactive position A, comes into contact with a supporting device movement assisting member 30 of the apparatus main assembly 150A. The supporting device movement assisting member 30 has a surface 30*a*, which is slanted relative to the direction in which the cartridge 250 is inserted into the apparatus main assembly 150A. The slanted surface 30*a* is the surface, with which the guiding member 17 of the supporting device 15 comes into contact as the cartridge 250 is inserted into the apparatus main assembly 150A. The supporting device movement assisting member 30 is solidly attached to a preset portion of the apparatus main assembly 150A.

3) As the cartridge 250 is inserted further into the apparatus main assembly 150A, the supporting device 15 is moved (guided) by the slanted surface 30*a* of the supporting device movement assisting member 30, in the direction indicated by an arrow E, being therefore moved from the inactive position A to the active position B. As the supporting device 15 is moved, the guiding portion 13 of the bearing 12 comes into contact with the first end of the metallic core 2*a* of the charging roller 2 (FIG. 4(*a*)). Thus, as the cartridge 250 is inserted further, the first end portion of the metallic core 2*a* is guided into the charging roller bearing portion 14 of the bearing 12 by the guiding portion 13 while remaining under the pressure generated in the direction of the arrow F (FIG. 4(*b*)). That is, the first end of the metallic core 2*a* is guided by the guiding portion 13 in such a manner that the first end portion of the charging roller 2 is moved in the direction of the arrow F, that is, toward the drum 1. The above described movement of the supporting device 15 and charging roller 2 is caused by the force (external force) applied to the cartridge 250 by a user to insert the cartridge 250 into the cartridge chamber of the apparatus main assembly 150A. In this case, the guiding portion 13 smoothly guides the metallic core 2*a* to the charging roller bearing portion 14. Therefore, the amount of force required of a user to insert the cartridge 250 into the apparatus main assembly 150A smoothly and gradually changes. Thus, the image forming apparatus and process cartridge in this embodiment is easier to operate. Further, because the guiding portion 13 smoothly guides the metallic core 2*a*, the amount of pressure to which the portion of the wall of the guiding portion 13, which is in contact with the metallic core 2*a*, is subjected, does not suddenly change. Therefore, the metallic core guiding portion 13 in this embodiment is significantly smaller in the amount of local frictional wear than any of the metallic core guiding portions in accordance with the prior art. Therefore, the cartridge 250 in this embodiment is significantly more durable, in terms of the frictional wear of the metallic core guiding portion 13, than any of the process cartridges in accordance with the prior art.

4) By the time the cartridge 250 is moved to its preset final position (image formation position) in the apparatus main assembly 150A, that is, by the time it becomes impossible for the cartridge 250 to be inserted further, the supporting device 15 is moved far enough from the inactive position A to be placed in the active position B. Further, the first end portion of the metallic core 2*a* is moved into the metallic core bearing portion 14 of the bearing 12 of the supporting device 15, and is supported by the portion 14 (FIG. 4(*c*)). Further, the first end portion of the charging roller 2 is placed in contact with the drum 1, and the pressure generating member 11, which is between the bearing 12 and guiding member 17 is compressed by a preset amount. Thus, the first end portion of the charging roller 2 is kept pressed upon the peripheral surface of the drum 1 by the preset amount of pressure, that is, the preset amount of force generated by resiliency of the pressure applying member 11 as the pressure applying member 11 is compressed. Further, the bearing 12 of the charging roller bearing apparatus 19, that is, the charging roller bearing apparatus on the second end side, is moved downward by the rotational moment of the second end portion of the metallic core 2*a*, which occurs as the metallic core 2*a* is made parallel to the drum 1. As the bearing 12 of the bearing apparatus 19 is moved downward, it compresses the pressure applying member 11 between itself and guiding member 17. Thus, the second end portion side of the charging roller 2 also is kept pressed upon the peripheral surface of the drum 1 by a preset amount of pressure generated by the resiliency of the pressure applying member 11 as the member 11 is compressed. Consequently, the charging roller 2 is pressed upon the peripheral surface of the drum 1 at the first and second ends by the pressure generated by the resiliency of the pressure applying members 11, one for one, in the direction indicated by the arrow F. Thus, the elastic layer 2*b* of the charging roller 2 is kept pressed upon the peripheral surface of the drum 1, uniformly across its entire range, making it possible for the drum to be charged.

Incidentally, the cartridge 250 may be provided with a member which is operable by a user to manually move the supporting device 15 from the inactive position A to the active position B, or manually return the supporting device 15 from the active position B to the inactive position A, so that the user is allowed to move the supporting device 15 from inactive position A to the active position B with the use of the supporting device moving member, to change the state of the charging roller 2 from the one in which the charging roller is not kept pressed upon the drum 1, to the one in which the charging roller 2 is kept pressed upon pressed upon the drum 1, when the user mounts the cartridge 250 into the cartridge chamber of the apparatus main assembly 150A. In such a case, the charging roller movement assisting member 30, with which the apparatus main assembly 150A in this embodiment is provided (FIG. 3), is unnecessary. Further, the user is allowed to change the state of the charging roller 2 from the one in which the charging roller 2 is kept pressured upon the drum 1, to the one in which the charging roller 2 is not kept pressed upon the drum 1, by moving the supporting device 15 from the active position to the inactive position A by operating the supporting device moving member. With the employment of this structural arrangement, the cartridge 250 can be placed in a state in which charging roller 2 is not kept pressed upon the drum 1 by the pressure applying member 11, not only when the cartridge 250 is shipped out of a factory, but also, right after the cartridge 250, which is in the apparatus main assembly 150A, is removed from the apparatus main assembly 150A. Thus, the cartridge 250 in this embodiment, which was removed from the apparatus main assembly 150A, but, is still usable, and the cartridge 250 in this embodiment, which was recovered to be recycled, can be made significantly smaller in the amount by which the charging roller 2 is deformed across the portion of the charging roller 2, which is in contact with the drum 1, by being kept pressed upon the drum 1 by the pressure applying member 11, than any of the comparable process cartridges (250) in accordance with the prior art. Further, the apparatus main assembly 150A may be provided with an automatic mechanism which can move the supporting device 15 of the cartridge 250 from the inactive position A to the active position B, or vice versa, when the cartridge 250 is in the apparatus main assembly 150A, and also, which can be controlled by a control circuit 200 to move the supporting device 15 from the inactive position A to the active position B, and keep the supporting device 15 in the active position B so that the charging roller 2 is kept in the state in which the charging roller 2 is kept pressed upon the drum 1, at least during the period in which an image forming operation is carried out by the apparatus 100. Providing the apparatus main assembly 150A with the automatic mechanism described above makes it possible to minimize the amount by which the portion of the charging roller 2, which is in contact with the peripheral surface of the drum 1, deforms, by moving the supporting device 15 from the active position B to the inactive position A to restore the state of the charging roller 2 from the one in which the charging roller 2 is kept pressed upon the drum 1, to the one in which the charging roller 2 is not kept pressed upon the drum 1, while no image is formed by the apparatus 100, for example, while the apparatus 100 is kept on standby. By structuring the cartridge 250 as described above, it is possible to prevent or minimize the problem that the portion of the charging roller 2, which is in contact with the drum 1, is deformed by the drum 1 while the cartridge 250 is not being used for image formation. The above described structural arrangement is also compatible with each of the following preferred embodiments of the present invention.

The cartridge 250 in this embodiment has a mechanism for moving the supporting device 15 which supports the first end of the charging roller 2, relative to the charging roller 2 to change the state of the charging roller 2 in terms of the relationship between the charging roller 2 and drum 1, from the state in which charging roller 2 is kept pressed upon the drum 1, and the state in which the charging roller 2 is not kept pressed upon the drum 1. That is, in the case of the cartridge 250 in this embodiment, the first position B and second position A, between which the supporting device 15 is movable, are different in the positional relationship between the charging roller 2 and supporting 15. The first position B is where the shaft 2*a* (metallic core) of the charging roller 2 is under the pressure from the pressure applying member 11 while remaining supported (borne) by the supporting portion 14. The second position A is where the shaft 2*a* (metallic core) of the charging roller 2 is not supported by the supporting portion 14, and there is a greater distance between the rotational axis of the drum 1 and the rotational axis of the charging roller 2 than in the first position B. The charging roller 2 and supporting device 15 are movable from the positions in which they are when the supporting device 15 is in the second position A, to the positions in which they are when the supporting device 15 is in the first position B, while they are moved relative to each other, with the shaft 2*a* (metallic core) of the charging roller 2 and the supporting device 15 being guided by the guiding portion 16*a*.

Since the cartridge 250 is structured as described above, the charging roller 2 can be kept in the state in which the drum 1 and charging roller 2 are not kept pressed upon each other by the pressure applying member 11, during the shipment of the cartridge 250, even thought the cartridge 250 is relatively simple in structure. Further, the amount by which the portion of the charging roller 2, which is in contact with the drum 1, is deformed by the drum 1, can be reduced by making smaller the amount of pressure generated by the pressure applying member 11 when no image is formed than when images are formed. Therefore, the combination of the process cartridge and image forming apparatus in this embodiment is more reliable in terms of the formation of high quality images than any of the counterpart in accordance with the prior art.

Regarding the state of contact between the charging roller 2 and drum 1, it is not mandatory that when the image forming apparatus 100 is not forming images, the charging roller 2 is not in contact with the drum 1. That is, even while the apparatus 100 is not forming images, the charging roller 2 may be in contact with the drum 1, as long as the charging roller 2 is not deformed by the contact between the charging roller 2 and drum 1. The dimension g1 of the elongated hole of the guiding portion 16*a* may be reduced within a range in which there is practically no effect of the contact between the charging roller 2 and drum 1, upon the charging roller 2. The reduction in the dimension g1 of the guiding portion 16*a* can reduce the range in which the charging roller 2 is allowed to moved, which in turn makes it possible to reduce the range in which the bearing 12 is slid. The reduction can also reduce the distance the supporting device 14 needs to be moved in the direction indicated by the arrow E. Therefore, the structural arrangement described above makes it possible to reduce an image forming apparatus and a process cartridge therefor, in size, without virtually any effects of the contact between the charging roller 2 and drum 1 upon the charging roller 1. In the description of some of the following preferred embodiments of the present invention, only the case in which the charging roller 2 is not kept pressed upon the drum 1, the charging roller 2 is not in contact with the drum 1, is mentioned. However, the application of the present invention is not limited to an image forming apparatus and a process cartridge therefor, which are structured so that when the charging roller 2 is not kept pressed upon the drum 1, the charging roller 2 is not in contact with the drum 1. That is, the present invention is also applicable to those structured so that even when the charging roller 2 is not kept pressed upon the drum 1, the charging roller 2 is in contact with the drum 1. That is, all that is required of an image forming apparatus and a process cartridge therefor is that when the charging roller 2 is not kept pressed upon the drum 1, the charging roller 2 is not in contact with the drum 1, or the contact pressure between the charging roller 2 and drum 1 is virtually zero, or significantly smaller than when the charging roller 2 is kept pressed upon the drum 1 for image formation.

Embodiment 2

Figure 5:
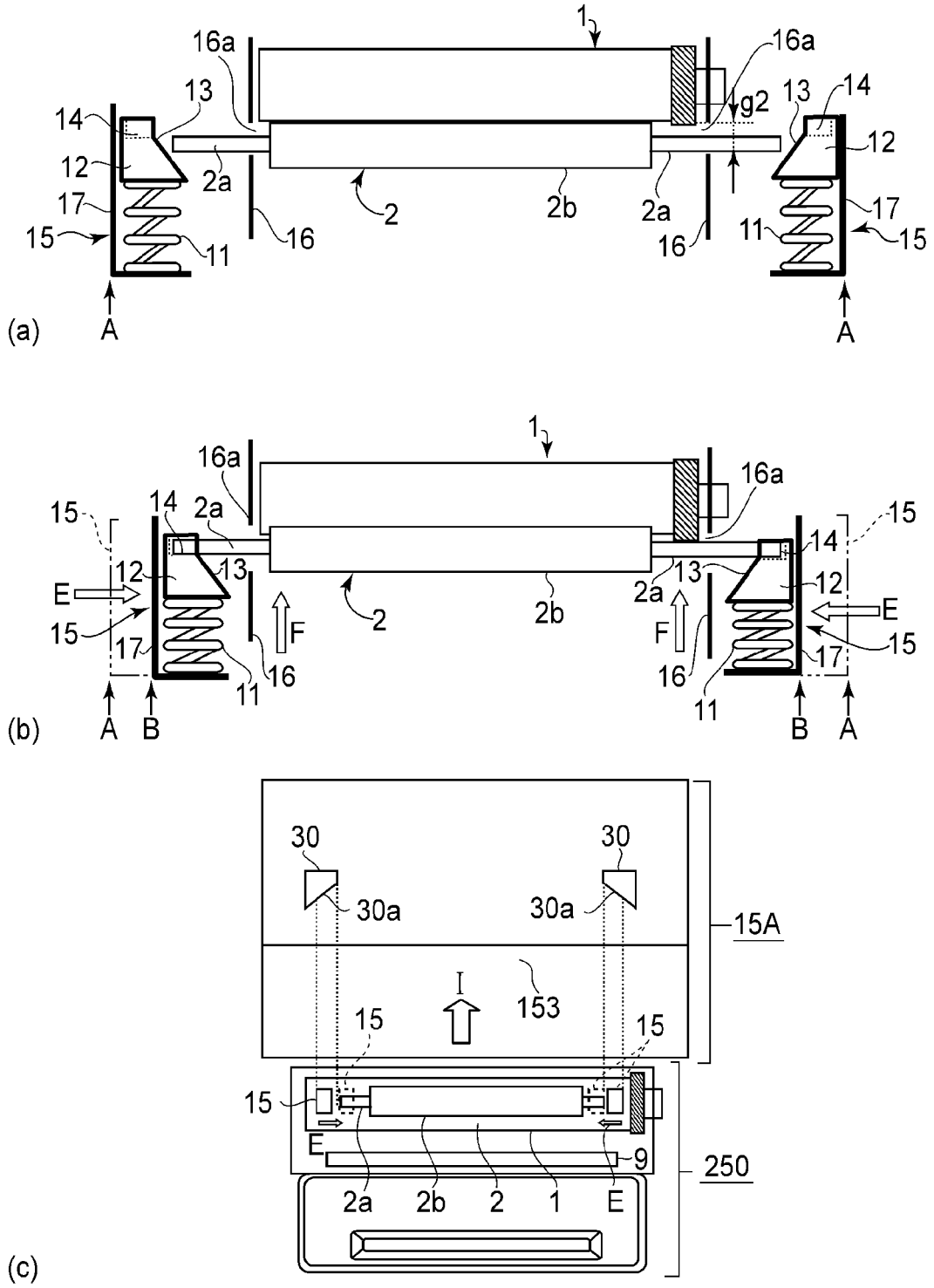
FIG. 5 is an illustration of the supporting device for the charging roller in Embodiment 2 of the present invention.

Next, referring to FIG. 5, the second preferred embodiment of the present invention is described. A cartridge 250 in this embodiment is different from the cartridge 250 in the first preferred embodiment in that both the supporting device (15) by which the charging roller 2 is supported at its lengthwise ends, one for one, are similar to the supporting device 15 in the first embodiment. The pair of supporting device 15 are the same in structure, but, are symmetrically positioned with reference to the lengthwise center of the cartridge 250. Otherwise, the cartridge 250 in this embodiment is the same in structure as the cartridge 250 in the first embodiment. Therefore, the portions of the cartridge 250 in this embodiment, which are similar to the counterpart of the cartridge 250 in the first embodiment are not described. When the cartridge 250 is shipped out of a factory, the two supporting devices 15, which are on the first and second sides, one for one, are in the inactive position A (second position) as shown in FIG. 5(*a*). When the cartridge 250 is in the state as shown in FIG. 5(*a*), each of the first and second end portions of the metallic core 2*a* is not held (borne) by the holding portion 14 of the bearing 12 of the supporting device 15, and the charging roller 2 is not kept pressed upon the drum 1 by the pressure applying member 11. That is, the charging roller 2 is held by the holding member 11, without being pressed upon the drum 1. The cartridge 250 is to be inserted into the cartridge chamber 153 of the apparatus main assembly 150A, while it is kept in the state shown in FIG. 5(*a*), in the direction indicated by an arrow I, as shown in FIG. 5(*c*). As the cartridge 250 is inserted, each of the supporting device 15, that is, the first and second supporting device 15, respectively, is moved from the inactive position A to the active position B by the supporting device movement assisting member 30 (and external force applied to cartridge 250), as shown in FIG. 5(*b*). Consequently, both the first and second ends of the metallic core 2*a* of the charging roller 2 are pressed toward the drum 1, whereby the charging roller 2 is pressed upon the peripheral surface of the drum 1, uniformly across its entire range, by a preset amount of pressure generated in the direction indicated by an arrow F, by the resiliency of the compressed pressure applying members 11, being readied for the charging of the drum 1.

Positioning the supporting device 15 at each of the first and second ends of the metallic core 2*a* as in this embodiment makes it possible to make a process cartridge smaller in the dimension g2 of the opening of the guiding portion 16*a* than that in the first embodiment (g2<g1), and therefore, it can reduce a process cartridge in the dimension perpendicular to the lengthwise direction of the cartridge.

Embodiment 3

Next, referring to FIGS. 6(*a*) and 6(*b*), the third preferred embodiment of the present invention is described. The third embodiment is different in structure from the second embodiment in that the supporting device 15, or the second supporting device, is solidly attached to the cartridge frame. When the process cartridge in this embodiment is in the state shown in FIG. 6(*a*), that is, when the first supporting device 15 is in the inactive position A (second position), neither the first nor second end portions of the metallic core 2*a* of the charging roller 2 is held (borne) by the metallic core holding portion 14 of the bearing 12 of the corresponding supporting device 15. That is, the charging roller 2 is not under the pressure generated by the pressure generating members 11 in the direction to press the charging roller 2 upon the drum 1. As the first supporting device 15 is moved from the inactive position A to the active position B (second position) while the cartridge is in the above described state, the metallic core 2*a* is sandwiched by the bearing 12 of the first supporting device 15 and the bearing 12 of the second supporting device 15, and is pushed by the pair of bearings 12 in the direction indicated by an arrow E. As the metallic core 2*a* is moved in the direction of the arrow E, the first and second ends of the metallic core 2 are guided by the guiding portions 13 into the metallic core holding portion 14 of the corresponding bearing 12, being eventually held by the holding portion 14 as shown in FIG. 6(*b*). Through this movement of the metallic core 2*a*, the elastic layer 2*b* of the charging roller 2 is placed in contact with the drum 1 across its entire range, and also, the bearings 12 of the first and second supporting device 15 are moved downward while compressing the pressure applying members 11. Thus, the first and second end portions of the charging roller 2 are pressed upon the drum 1 by a preset amount of pressure generated by the resiliency of the compressed pressure applying members 11. Thus, the entirety of the charging roller 2 is kept pressed upon the drum 1 in the direction indicated by an arrow F by the preset amount of pressure. That is, the elastic layer 2*b* of the charging roller 2 is placed in contact with the peripheral surface of the drum 1 uniformly across its entire range, being readied for uniformly charging the drum 1.

Embodiment 4

Next, referring to FIGS. 6(*a*) and 6(*d*), the fourth preferred embodiment of the present invention is described. The process cartridge in the fourth embodiment is different from those in the first to third embodiments in that its guiding portion 16*a* is provided with a separating means for keeping the charging roller 2 separated from the drum 1 while the charging member 2 is not under the pressure from the pressure applying member 11. Otherwise, the fourth embodiment is the same as the first to third embodiments. Also in this embodiment, the state of the charging roller 2 is changed from the state in which the charging roller 2 is not kept pressed upon the drum 1 to the state in which the charging roller 2*a* is kept pressed upon the drum 1, by moving the supporting device 15 from the inactive position A to the active position B, as in the first to third embodiments described above. The fourth embodiment is different from the first to third embodiment in that even if the cartridge 250 is subjected to vibrations and/or is changed in attitude relative to the direction of gravity, while it is in the state in which its charging roller 2 is not under the pressure from the pressure applying member 11, the charging roller 2 is prevented from bouncing around. Therefore, it is ensured that while the charging roller 2 is not under the pressure from the pressure applying member 11, it remains separated from the drum 1. During an image forming operation, the charging roller 2 charges the drum 1 while remaining pressed upon the drum 1 in the direction indicated by an arrow F. However, in order to minimize the problem that if the charging roller 1 is kept pressed upon the drum 1 for a substantial length of time when the cartridge is not used for image formation, the portion of the charging roller 2, which is in contact with the drum 1, is deformed by the drum 1, it is desired that during the shipment of the process cartridge, the charging roller 2 is not kept pressed upon the drum 1, and also, that it is ensured that the charging roller 2 remains separated from the drum 1.

FIG. 6(*c*) shows one of the above described means for keeping the charging roller 2 separated from the drum 1. More specifically, the guiding member 16 is provided with a pair of elastic stoppers 23 as the means for preventing the metallic core 2*a* from shifting in position within the hole of the guiding portion 16*a*. Providing the guiding member 16 with the elastic stoppers 23 makes it possible to ensure that while the charging roller 2 is not kept pressured upon the drum 1, the charging roller 2 is kept in a preset position in which the charging roller 2 is not in contact with the drum 1. However, as the charging roller 2 is moved toward the drum 1 in the direction of the arrow F by the movement of the supporting device 15 from the inactive position A (second position) to the active position B (first position), the metallic core 2*a* is moved toward the drum 1 through the hole of the guiding portion 16*a* by the force generated by the movement of the supporting device 15, against the force applied to the metallic core 2*a* by the resiliency of the stoppers 23. Thus, in spite of the presence of the stoppers 23, the charging roller 2 can be pressed upon the drum 1.

FIG. 6(*d*) shows another means for keeping the charging roller 2 separated from the drum 1. In this case, the guiding member 16 is provided with an elastic member 24 (hatched portion in FIG. 6(*d*)) as the means for keeping the charging roller 2 separated from the drum 1. The elastic member 24 is made of a soft and elastic substance such as sponge, and is placed in the top portion (drum side) of the hole of the guiding portion 16*a*. While the charging roller 2 is not kept pressed upon the drum 1, the metallic core 2*a* of the charging roller 2 is kept on the opposite side of the hole of the guiding portion 16*a* from the drum 1, by the elastic member 24. Therefore, it is ensured that while the charging roller 2 is not kept pressed upon the drum 1, the charging roller 2 is kept in a preset position in which the charging roller 2 is kept separated from the drum 1. Then, as the charging roller 2 is moved toward the drum 1 as indicated by an arrow F by the movement of the supporting device 15 from the inactive position A to the active position B, the metallic core 2*a* is made to compress the elastic member 24 by the force which is moving the charging roller 2 toward the drum 1. Then, the charging roller 2 is pressed upon the drum 1 and remains pressed upon while keeping the elastic member 24 compressed.

As will be evident from the description of the fourth embodiment, the fourth embodiment makes it possible to keep the charging roller 2 separated from the drum 1, without employing a complicated structural arrangement. More specifically, during the shipment of the process cartridge from a factory, the charging roller 2 is kept separated from the drum 1 by a separating means such as those described above. Therefore, even if the cartridge 250 is changed in attitude, or subjected to a large amount of impact, while it is shipped out of a factory and distributed, the cartridge 250 will be minimal in the amount by which the charging roller 2 deforms across the area which comes into contact with the drum 1. Thus, it is ensured that the image forming apparatus 100 outputs images of high quality. Although the fourth embodiment was described with reference to the structure of the separating means, this embodiment is not intended to limit the present invention in scope. Further, it is needless to say that the structure arrangement for the separating means for the cartridge in this embodiment is also compatible with the cartridges in the following preferred embodiments of the present invention.

Embodiment 5

Next, referring to FIG. 7, the fifth preferred embodiment of the present invention is described. In the case of the cartridge in the fifth embodiment, the metallic core holding (bearing) portion 14 of the bearing 12 of the supporting device 15 does not have a groove for holding the end portion of the metallic core 2*a* in a preset position when the charging roller 2 is kept pressed upon the drum 1. The portions of the cartridge in this embodiment, which are not described here, are the same in structure as the counterpart in the first to fourth embodiments.

Referring to FIG. 7(*a*), the metallic core holding (bearing) portion 14 of the bearing 12 in this embodiment does not have a groove for holding the metallic core 2*a* in a preset position. Instead, the guiding portion 16*a* is given the role of controlling the movement of the metallic core 2*a* in the direction perpendicular to the direction indicated by an arrow F, that is, the direction in which the charging roller 2 is kept pressed by the pressure applying member 11, in addition to the direction of the arrow F. That is, the guiding portion 16*a* controls the metallic core 2*a* in such a manner that the metallic core 2*a* is allowed to move only in the direction parallel to the direction of the arrow F, that is, the direction in which the charging roller 2 is pressed by the pressure applying member 11. Therefore, while the charging roller 2 is kept pressed toward the drum 1 by the pressure applying member 11, the metallic core 2*a* is prevented by the guiding portion 16*a* from moving in the direction other than the direction of the arrow F, that is, the direction in which the charging roller 2 is pressed by the pressure applying member 11. In other words, the guiding portion 16*a* in this embodiment is given the role of the groove of the metallic core holding portion 14 of the bearing 12 in each of the first to fourth embodiments.

As for the mechanism, in this embodiment, for changing the state of the charging roller 2 in terms of the positional relationship between the charging roller 2 and drum 1, from the one in which the charging roller 2 is not kept pressed upon the drum 1, to the one in which the charging roller 2 is kept pressed upon the drum 1, it is the same as that in the first embodiment. FIGS. 7(*c*), 7(*d*), and 7(*e*) correspond to FIGS. 4(*a*), 4(*b*), and 4(*c*), respectively. Referring to FIG. 7(*c*), when the supporting device 15 is in the inactive position A (first position), the metallic core 2*a* of the charging roller 2 is not being held by the holding portion 14 of the bearing 12 of the supporting device 15, and the charging roller 2 is not kept pressured toward the drum 1 by the pressure applying member 11. Further, the charging roller 2 is not in contact with the drum 1. Further, the movement of the charging roller 2 is not under the control from the guiding portion 16*a*, except that the metallic core 2*a* of the charging roller 2 is resting on the bottom end of the hole of the guiding portion 16*a*. Next, referring to FIG. 7(*d*), as the supporting device 15 is moved from the inactive position A toward the active position B (second position) in the direction indicated by an arrow E, the guiding portion 13 of the supporting device 15 comes into contact with the metallic core 2*a*, and presses on the metallic core 2*a*. Thus, the metallic core 2*a* is guided to the metallic core holding portion 14 by the force generated in the direction indicated by the arrow F by the movement of the supporting device 15. Consequently, the metallic core 2*a* is held by the holding portion 14 as shown in FIG. 7(*e*). Further, the pressure applying member 11 is compressed more than it was when it was in the state shown in FIG. 7(*c*), generating thereby such a force that is directed toward the axial line of the metallic core 2*a*. Thus, the charging roller 2 is kept pressed upon the drum 1 in the direction of the arrow F, being thereby readied for charging the drum 1. At this point in the movement of the charging roller 2, the metallic core 2*a* of the charging roller 2 is regulated in movement by the guiding portion 16*a* so that it cannot move in any direction except for the direction in which it is being pressed (direction of arrow F). Thus, the charging roller 2 comes into contact with the drum 1, in a preset position, and remains in contact with the drum 1, in the preset position. As will be evident from the description of the fifth embodiment given above, even if the bearing 12 is simple in structure, that is, even if the bearing 12 does not have the aforementioned groove, the same effects as those in the first to fourth embodiments can be obtained.

The shape of the bearing 12 of the supporting member 15 does not need to be limited to those in the preceding embodiments. For example, it may be one of the shapes shown in FIGS. 8(*a*), 8(*b*), and 8(*c*). In the cases of the bearings (12) shaped as shown in FIGS. 8(*a*) and 8(*b*), the metallic core guiding surface(s) of the guiding portion 13 is smooth and angled, and therefore, the guiding portion 13 of the bearing 12 can smoothly guide the metallic core 2*a* to the metallic core holding portion 14, being therefore relatively small in the amount of local frictional wear, and superior in terms of the operability of a process cartridge. The shape of the bearing 12 in the first embodiment is an example of a bearing, the guiding portion (13) and holding portion (14) of which are given such a curvature that matches the shape of the metallic core 2*a*, as described with reference to FIG. 2(*d*). In comparison, in the case of the bearing 12 shaped as shown in FIG. 8(*a*), the guiding portion 13 and holding portion 14 are made up of two flat surfaces (do not have curvature). This bearing (12) also can smoothly guide the metallic core 2*a* to the holding portion 14, being therefore excellent in terms of the operability of a process cartridge, and relatively small in the amount of local frictional wear. In the case of the bearing (12) shaped as shown in FIG. 8(*b*), both the guiding portion 13 and holding portion 14 enclose the end portion of the metallic core 2*a*. Not only can this shape for a bearing (12) make a process cartridge easier and more comfortable to operate, and reduce a bearing (12) in local frictional wear, but also, double a bearing (12) as a guiding portion (16*a*). This feature will be described in detail in the description of the sixth preferred embodiment of the present invention.

The bearing 12 may be shaped as shown in FIG. 8(*c*). That is, the bearing 12 may be shaped so that its guiding portion 13 does not have a slanted surface. Next, referring to FIGS. 8(*d*) and 8(*e*), the requirements for the bearing 12 shaped as shown FIG. 8(*c*) are described. Referring to FIG. 8(*e*), as long as the end portion of the metallic core 2*a* is tapered, and each of the heights (dimensions) D1, D2, and D3 of the steps, one for one, of the stair-cased portion of the metallic core guiding portion 13 of the bearing 12, is less than the dimension of the tapered portion of the end of the metallic core 2*a*, in terms of the direction parallel to the direction in which the metallic core 2*a* is moved toward the drum 1, the metallic core 2*a* can be guided to the metallic core holding portion 14. However, if the dimensions D4, and D5 of the stair-cased portions of the guiding portion 13, in terms of the direction parallel to the direction in which the metallic core 2*a* is moved toward the drum 1 are greater than the dimension d of the tapered end portion of the metallic core 2*a* in terms of the same direction, metallic core 2*a* cannot be guided to the holding portion 14. In other words, as long as the dimension d of the tapered portion of the end of the metallic core 2*a*, and the dimension (height) of each of the steps of the stair-cased guiding portion 13 of the bearing 12, are set so that the metallic core 2*a* can be guided to the holding portion 14 by the guided portion 13, the guiding portion 13 properly functions as a metallic core guiding portion.

Embodiment 6

Next, referring to FIG. 9, the sixth preferred embodiment of the present invention is described. This embodiment is an example of a process cartridge in accordance with the present invention, the bearing 12 of the supporting device 15 of which is provided with a guiding portion (16*a*). The portions of the process cartridge other than the bearing 12 are the same in structure as the counterpart in the first embodiment. FIG. 9(*d*) is a drawing for describing the structure of the bearing 12 in this embodiment. In the preceding embodiments of the present invention, the bearing 12 and guiding portion 16*a* are structurally independent from each other. In this embodiment, however, the guiding portion 16*a* is an integral part of the bearing 12. Next, referring to FIGS. 9(*a*), 9(*b*), and 9(*c*), the mechanism, in this embodiment, for changing the state of the charging roller 2, from the state in which the charging roller 2 is not kept pressured toward the drum 1 by the pressure applying member 11, to the state in which the charging roller 2 is kept pressured toward the drum 1 by the pressure applying member 11, is described. The mechanism in this embodiment is basically the same as the mechanism in the first embodiment. FIGS. 9(*a*), 9(*b*), and 9(*c*) correspond to FIGS. 4(*a*), 4(*b*), and 4(*c*), respectively.

Referring to FIG. 9(*a*), when the supporting device 15 is in the inactive position A (second position), the charging roller 2 is not pressured toward the drum 1 by the pressure applying member 11, and the metallic core 2*a* of the charging roller 2 is not held by the holding portion 14 of the supporting device 15. Further, the metallic core 2*a* is in contact with a part of the guiding portion 13. Further, the movement of the metallic core 2*a* is regulated by the guiding portion 16*a*, which is an integral part of the bearing 12, being allowed to move only in the roughly the same direction as the direction in which the metallic core 2*a* is pressed by the pressure applying member 11, in a preset range. Moreover, the cartridge 250 is structured so that the charging roller 2 does not become dislodged by becoming disengaged from the guiding portion 16*a*. As the supporting device 15 is moved from the inactive position A toward the active position B (second position) in the direction indicated by an arrow E, the guiding portion 13 of the supporting device 15 comes into contact with the metallic core 2*a*, and presses on the metallic core 2*a*. Thus, the metallic core 2*a* is guided to the metallic core holding portion 14 by the force generated in the direction indicated by the arrow F by the movement of the supporting device 15. Consequently, the metallic core 2*a* is held by the holding portion 14 as shown in FIG. 9(*c*). Further, the pressure applying member 11 is compressed more than it was when it was in the state as shown in FIG. 9(*a*), generating therefore such a force that is directed toward the axial line of the metallic core 2*a*. Thus, the charging roller 2 is kept pressed upon the drum 1 in the direction of the arrow F, being thereby readied for charging the drum 1. As will be evident from the description of the sixth embodiment given above, even if the cartridge 250 is simplified by making the guiding portion 14 a part of the bearing 12, the same effects as those obtainable by the cartridge 250 in the first embodiment can be obtained. Making the guiding portion 16*a* a part of the bearing 12 does need to be limited to the cartridge 250 in this embodiment. That is, it is also applicable to the cartridge 250 other than the cartridge 250 in this embodiment.

Embodiment 7

Next, referring to FIG. 10, the seventh preferred embodiment of the present invention is described. The process cartridge in this embodiment is provided with a tension spring 40 as an auxiliary means for pulling the supporting device 15 in the direction which is parallel to the axial line of the charging roller 2, and opposite to the direction, indicated by an arrow E, in which the supporting device 15 is moved toward the charging roller 2. The portions of the cartridge 250 in this embodiment, which are not specifically described, are the same in structure as the counterpart of the cartridge 250 in the first embodiment. FIGS. 10(*a*), 10(*b*), and 10(*c*) correspond to FIGS. 4(*a*), 4(*b*), and 4(*c*).

The spring 40 is between the stationary member 41 of the cartridge frame and the guiding member 17. Thus, the supporting device 15 always remains pulled toward the inactive position A (second position) by the spring 40. Therefore, as the cartridge 250 is freed from external force (for example, as the cartridge 250 is removed from apparatus main assembly 150A), the supporting device 15 is automatically moved to the inactive position A, and is kept therein, by the tension of the spring 40. That is, when the cartridge 250 is free of external force, the supporting device 15 is kept in the inactive position A by the tension of the spring 40. As this cartridge 250 is mounted into the cartridge chamber 153 of the apparatus main assembly 150A as shown in FIG. 3 or FIG. 5(*c*), the supporting device 15 is moved from the inactive position A toward the active position B (first position) by the supporting device moving auxiliary member 30, against the tension of the spring 40, as shown in FIG. 10(*b*). Then, as the supporting device 15 reaches the active position B, or the destination, it is retained in the position as shown in FIG. 10(*c*). That is, the charging roller 2, which was not under the pressure from the pressure applying member 11, comes under the pressure from the pressure applying member 11. On the other hand, as the cartridge 250 is extracted from the apparatus main assembly 150A, the supporting device 15 is automatically returned from the active position B to the inactive position A by the tension of the spring 40 as the auxiliary means for moving the supporting device 15. That is, the charging roller 2 which is being under the pressure from the pressure applying member 11 is automatically freed from the pressure.

As described above, the cartridge 250 in this embodiment is provided with the supporting device moving auxiliary means 40, which is for moving the supporting device 15 away from the shaft 2*a* (metallic core) of the charging roller 2. With the provision of the supporting device moving auxiliary means 40, it is possible to automatically put the charging roller 2 in the state in which the charging roller 2 is free from the pressure from the pressure applying member 11, as soon as the force which keeps the charging roller 2 pressed toward the drum 1 is removed for any reason. Thus, providing the cartridge 250 with the supporting device moving auxiliary means 40 can reduce the amount by which the portion of the charging roller 2, which is in contact with the drum 1, is deformed by the drum 1, even when the cartridge 250 is not being shipped from a factory to be distributed. Therefore, the cartridge 250 in this embodiment is more reliable in terms of image quality. That is, this embodiment makes it possible to automatically restore the cartridge 250, in which the charging roller 2 which was not under the pressure from the pressure applying member 11, and then, was placed under the pressure from the pressure applying member 11, to the state in which the charging roller 2 is free from the pressure from the pressure applying member 11, without the employment of a complicated structural arrangement, as soon as the external force to which the supporting device 15 is being subjected is removed. Therefore, this embodiment can minimize the problem that after the cartridge 250 is mounted in the apparatus main assembly 150A, and then, is temporarily removed, or the cartridge 250 is recovered for recycling, the portion of the charging roller 2, which is kept in contact with the drum 1 by the pressure applying member 11, is deformed by the drum 1.

Although in this embodiment, the tension spring 40 was used as the supporting device moving auxiliary means for freeing again the charging roller 2 from the pressure from the pressure applying member 11 after the state of the charging roller 2 is changed from the state in which the charging roller 2 is not under the pressure from the pressure applying member 11, to the state in which the charging roller 2 is under the pressure from the pressure applying member 11. However, the choice of the supporting device moving auxiliary means does not need to be limited to a tension spring (40). Further, the structural arrangement of the cartridge 250 in this embodiment is also compatible with the cartridge 250*s* in the embodiments other than this one.

Embodiment 8

Next, referring to FIGS. 11 and 13, the eighth preferred embodiment of the present invention is described. This embodiment is one of the examples of modification of the first embodiment. Unlike the bearing 12 of the supporting device 15 in the first embodiment, the bearing 12 of the supporting device 15 in this embodiment does not have a groove (14) for holding the metallic core 2*a* in a preset position, and a guiding portion (13) for guiding the metallic core 2*a* to the metallic core holding portion 14. Instead, the first end of the metallic core 2*a* is tapered (tapered portion 20). The structural components of the cartridge 250 and apparatus main assembly 150A in this embodiment are similar in structure as the counterpart in the first embodiment, unless specifically noted. The relationship between the tapered portion 20 and metallic core holding portion 14 is as follows. The cartridge 250 in this embodiment is structured so that as the supporting device 15 is moved from the inactive position A toward the active position B in the direction indicated by an arrow E when the point at which the metallic core 2*a* is supported by the guiding portion 16*a* is farthest from the drum 1 than any point at which the metallic core 2*a* is supported by the guiding portion 16*a*, the top edge of the holding portion 14 comes into contact with the tapered portion 20 of the metallic core 2*a*. Further, like the metallic core 2*a* in the fifth embodiment, which was described with reference to FIG. 7(*b*), the metallic core 2*a* in this embodiment is regulated in movement by the guiding portion 16*a* in such a manner that the metallic core 2*a* is not allowed to move in the directions other than the direction (indicated by arrow F) in which the metallic core 2*a* is pressured by the pressure applying member 11 (FIG. 11(*e*)).

The mechanism for changing the state of the charging roller 2 from the state in which the charging roller 2 is not under the pressure from the pressure applying member 11, to the state in which the charging roller 2 is under the pressure from the pressure applying member 11, is roughly the same as that in the first embodiment. FIGS. 11(*a*), 11(*b*), and 11(*c*) correspond to FIGS. 4(*a*), 4(*b*), and 4(*c*). Referring to FIG. 11(*a*), when the supporting device 15 is in the inactive position A, the charging roller 2 is not under the pressure from the pressure applying member 11, and the first end of the metallic core 2*a* of the charging roller 2 is not supported by the metallic core holding portion 14 of the supporting device 15. That is, the metallic core 2*a* is supported by the guiding portion 16*a*. As the cartridge 250, which is in the above described state, is inserted into the cartridge chamber 153 of the apparatus main assembly 150A as shown in FIG. 12, the supporting device 15 is moved from the inactive position A toward the active position B in the direction indicated by an arrow E, like the supporting device 15 of the cartridge 250 in the first embodiment. By this movement of the supporting device 15, the bearing 12 of the supporting device 15 is made to come into contact with the tapered portion 20 of the first end of the metallic core 2*a*, and presses on the tapered portions 20. Thus, the metallic core 2*a* is guided to the holding portion 14 while being subjected to the force generated in the direction indicated by an arrow F, as shown in FIG. 11(*b*). As the cartridge 250 is inserted further, the first end of the metallic core 2*a* is eventually held by the holding portion 14 as shown in FIG. 11(*c*). As for the pressure applying member 11, it is compressed more than it was when it was in the state shown in FIG. 11(*a*). Thus, it generates such a force that works in the direction of the arrow F. Therefore, the first end of the metallic core 2*a* is pressured in the direction of the arrow F. The other (second) end of the metallic core 2*a* is supported by a metallic core bearing apparatus similar to the metallic core bearing apparatus 19 in the first embodiment. Thus, as the cartridge 250 is mounted into the apparatus main assembly 150A, the second end of the metallic core 2*a* also is pressed upon the drum 1 as the counterpart in the first embodiment was. Thus, the charging roller 2 is placed in contact with the drum 1 uniformly across its entirety, being thereby readied for charging the drum 1. As is evident from the description of this embodiment given above, even if the bearing 12 is not provided with the guiding portion 13, and the metallic core holding portion 14 of the bearing 12 does not have the metallic core positioning groove, being therefore simple in shape, the same effects as those obtainable in the first embodiment can be obtained.

Embodiment 9

Next, referring to FIGS. 13 and 14, the ninth preferred embodiment of the present invention is described. In this embodiment, the state of the charging roller 2 is changed from the state in which the charging roller 2 is not under the pressure from the pressure applying member 11, to the state in which the charging roller 2 is under the pressure from the pressure applying member 11, by the movement of the supporting device 15 in the direction perpendicular to the axial line of the charging roller 2. Except for the direction of the movement of the supporting device 15 and the shape of the bearing 12, the cartridge 250 in this embodiment is the same in structure as that in the first embodiment. FIGS. 13(*a*), 13(*b*), and 13(*c*) are schematic drawings of the mechanism, in this embodiment, for changing the state of the charging roller 2. Referring to FIG. 12(*d*), the bearing 12 of the supporting device 15 has a metallic core guiding portion 13 and a metallic core holding portion 14. The guiding portion 13 is a flat and slanted surface for smoothly guiding the metallic core 2*a* to the metallic core holding portion 14. The holding portion 14 has a semi-cylindrical groove for ensuring that the metallic core 2*a* remains in a preset position. The groove is slightly larger in curvature than that of the metallic core 2*a*. The supporting device 15 is movable in the direction indicated by an arrow F, which is perpendicular to the axial line of the charging roller 2 and is the direction in which the supporting device 15 is moved toward the charging roller 2. The charging roller 2 is controlled in movement by the guiding portion 16*a* in such a manner that it is allowed to move only in the direction which is roughly the same as the direction in which the charging roller 2 is pressured by the pressure applying member 11, and also, only in a preset range.

Referring to FIG. 13(*a*), when the supporting device 15 is in the inactive position A (second position), the charging roller 2 is not under the pressure from the pressure applying member 11. Thus, the first end of the metallic core 2*a* of the charging roller 2 is not held by the holding portion 14 of the supporting device 15. Instead, the metallic core 2*a* is held by the guiding portion 16*a*. It is in this state that the cartridge 250 is inserted into the cartridge chamber 153 of the apparatus main assembly 150A as shown in FIG. 13(*e*). As the cartridge 250 is inserted, the supporting device 15 is moved from the inactive position A toward the active position B (first position) by the supporting device movement assisting member 30 of the apparatus main assembly 150A in the direction indicated by an arrow E, as is the supporting device 15 of the cartridge 250 in the first embodiment. Next, referring to FIG. 13(*b*), as the supporting device 15 is moved in the direction of the arrow E, the guiding portion 13 of the supporting device 15 comes into contact with the first end of the metallic core 2*a*, and the first end of the metallic core 2*a* is guided to the holding portion 14 by the guiding portion 13 while being subjected to the force, the direction of which is parallel to the direction of the arrow F. As the cartridge 250 is inserted further, the first end of the metallic core 2*a* is eventually held by the holding portion 14 as shown in FIG. 13(*c*). As for the pressure applying member 11, it is compressed more than it remained compressed when it was in the state shown in FIG. 13(*a*), generating thereby more pressure. Thus, the first end of the charging roller 2 is pressed in the direction of the arrow F. The other end (second end) of the metallic core 2*a* is supported by the metallic core bearing apparatus 19 as is the counterpart in the first embodiment. Thus, as the cartridge 250 is inserted into the apparatus main assembly 150A, the other end of the charging roller 2 also is pressed upon the drum 1. Consequently, the charging roller 2 is placed in contact with the drum 1 uniformly across the entire range, being thereby readied for charging the drum 1.

As described above, in this embodiment, the state of the cartridge 250 is changed from the state in which the charging roller 2 is not pressed upon the drum 1 by the pressure applying member 11, to the state in which the charging roller 2 is kept pressed upon the drum 1 by the pressure applying member 11, by the movement of the supporting device 15 in the direction perpendicular to the axial line of the charging roller 2. Thus, the cartridge 250 in this embodiment is smaller in the dimension in terms of the direction parallel to the axial line of the charging roller 2 than the cartridge 250 in the first embodiment; this embodiment can reduce a process cartridge in the dimension in terms of the direction parallel to the axial line of its charging roller.

Figure 4:
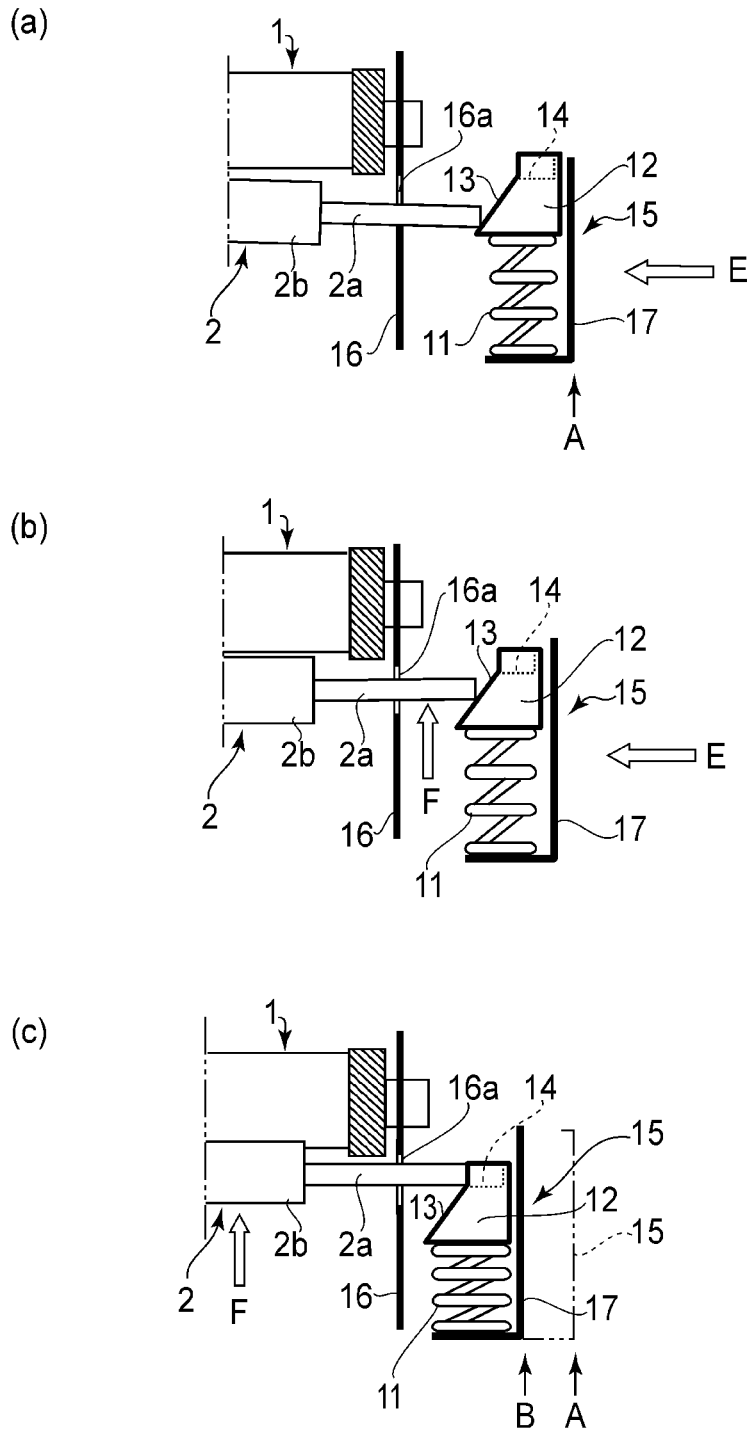
FIG. 4 is an illustration of an operation of the supporting device in Embodiment 1.

The shape of the bearing 12 of the supporting device 15 of the cartridge 250 structured so that the supporting device 15 is moved in the direction perpendicular to the axial line of the charging roller 2 does not need to be limited to the one shown in FIG. 13(*d*). That is, all that is necessary is that the bearing 12 is shaped so that it functions like the bearing 12 in the fifth embodiment. In other words, the guiding portion 13 and holding portion 14 may be flat, slant, and/or in the form of an edge (edge of triangular rib), or a combination of these features. Shown in FIGS. 14(*a*)-14(*g*) are examples of the shape for the bearing 12. Incidentally, the shape of the bearing 12 does not need to be limited to those shown in FIGS. 14(*a*)-14(*g*). Those shown in FIGS. 14(*a*)-14(*g*) are examples of the bearing 12, the guiding portion 13 of which is a slanted and flat surface, or curved and flat surface, and the holding portion 14 of which has a groove for holding the metallic core 2*a* in a preset position. In the case of the bearings 12 shaped as shown in FIGS. 14(*a*), 4(*b*), and 4(*c*), the guiding portion 13 has only a single surface. In the case of the bearing 12 shaped as shown in FIG. 14(*d*), the guiding portion 13 has two surfaces. In the case of the bearing 12 shaped as shown in FIG. 4(*e*), the guiding portion 13 has three surfaces. Further, in the case of the bearings 12 shaped as shown in FIGS. 14(*a*), 14(*b*), 14(*d*), and 14(*e*), the guiding portions 13 are flat. In the case of the bearing 12 shaped as shown in FIG. 14(*c*), the guiding portion 13 is curved. In the case of the bearings 12 shaped as shown in FIGS. 14(*c*), 14(*d*), and 14(*e*), the groove of the holding portion 14 has only a single curved surface. In the case of the bearing 12 shaped as shown FIG. 14(*a*), the groove of the holding portion 14 has two flat surfaces. In the case of the bearing 12 shaped as shown in FIG. 14(*b*), the groove of the holding portion 14 has three surfaces. In the case of the bearing 12 shaped as shown in FIG. 14(*f*), the holding portion 14 does not have a groove for holding the metallic core 2*a* in a preset position, but, the metallic core 2*a* can be held in the preset position by the guiding portion 16*a* as in the fifth embodiment described above. Further, the guiding portion 13 does not need to have a flat and slanted surface. That is, it may be shaped as shown in FIG. 14(*g*). Next, referring to FIGS. 14(*h*) and 14(*i*), the requirements for the bearing 12 shaped as shown in FIG. 14(*g*) are described. That is, as long as the heights D1 and D2 of the steps are less than the radius d of the metallic core 2*a* as shown in FIG. 14(*h*), the metallic core 2*a* can be guided by the guiding portion 13 to the holding portion 14. However, if the maximum values of the heights D3 and D4 of the guiding portion 14 are greater than the radius d of the metallic core 2*a* as shown in FIG. 14(*i*), the metallic core 2*a* cannot be guided to the holding portion 14 by the guiding portion 13. It is desired that the bearing 12 has the guiding portion 13. However, all that is required is that the bearing 12 has the holding portion 14 for holding the metallic core 2*a*.

Embodiment 10

Next, referring to FIG. 15, the tenth preferred embodiment of the present invention is described. This embodiment is an example of a modification of the ninth embodiment. In this embodiment, the bearing 12 of the supporting device 15 does not have the guiding portion 13. Further, the metallic core holding portion 14 of the bearing 12 of the supporting device 15 does not have the groove for holding the metallic core 2*a* in a preset position. Otherwise, the components of the cartridge 250 in this embodiment are the same in structure as the counterpart in the ninth embodiment. In the eighth embodiment described above, the supporting device 15 is moved in the direction parallel to the axial line of the charging roller 2, and the first end of the metallic core 2*a* was tapered (tapered portion 20), instead of providing the guiding portion 13 and holding portion 14 of the bearing 12 with a groove. In comparison, in this embodiment, the supporting device 15 is moved in the direction perpendicular to the axial line of the charging roller 2. Thus, the role of the tapered portion 20 in the eighth embodiment is played by the peripheral surface of the metallic core 2*a*.

FIGS. 15(*a*)-15(*c*) are schematic drawings of the mechanism, in this embodiment, for changing the state of the charging roller 2. FIG. 15(*d*) is a drawing for showing the positional relationship between the metallic core 2*a* and holding portion 14, and shows the relationship when the point at which the metallic core 2*a* is supported by the guiding portion 16*a* is farthest from the drum 1. The cartridge 250 is structured so that when the bearing member 12 is moved in the direction indicated by an arrow E, which is perpendicular to the axial line of the charging roller 2, and is parallel to the direction in which the supporting device 15 is moved toward the charging roller 2, the end of the supporting portion 14 begins to contact the opposite side of the peripheral surface of the metallic core 2*a* from the drum 1, with reference to a plane P which coincides with the axial line of the metallic core 2*a* and is parallel to the direction of the arrow E. Further, the movement of the metallic core 2*a* is regulated by the guiding portion 16*a* in such a manner that the metallic core 2*a* is prevented by the guiding portion 16*a* from moving in the direction other than the direction (of arrow F) in which the metallic core 2*a* is pressed by the pressure applying member 11.

The mechanism for changing the state of the charging roller 2 from the one in which the charging roller 2 is not under the pressure from the pressure applying member 11 to the one in which the charging roller 2 is under the pressure from the pressure applying member 11 is the same as the mechanism in the embodiment 9. That is, referring to FIG. 15(*a*), when the supporting device 15 is in the inactive position A (second position), the charging roller 2 is not kept pressed on the drum 1 by the pressure applying member 11, and the metallic core 2*a* of the charging roller 2 is not supported by the supporting portion 14 of the supporting device 15; it is supported by the guiding portion 16*a*. The cartridge 250 is inserted into the cartridge chamber 153 of the apparatus main assembly 150A as shown in FIG. 13(*e*). As the cartridge 250 is inserted, the supporting device 15 is moved from the inactive position A to the active position B (first position) by the supporting device movement assisting member 30 in the direction indicated by an arrow E. By this movement of the supporting device 15, the bearing 12 of the supporting device 15 is placed in contact with the peripheral surface of the metallic core 2*a*, as shown in FIG. 15(*b*), and the metallic core 2*a* is guided to the holding portion 14 by the force generated by the interaction of the peripheral surface of the metallic core 2*a* and the bearing 12. As the cartridge 250 is inserted further, the first end of the metallic core 2*a* is eventually held by the holding portion 14 as shown in FIG. 15(*c*). As for the pressure applying member 11, it is compressed more than it was when the supporting device 15 was in the position shown in FIG. 15(*a*), generating thereby an additional force, whereby the first end of the charging roller 2 is pressed in the direction of the arrow F. As for the other end (second end) of the metallic core 2*a*, it is supported by the bearing apparatus 19 as it is in the first embodiment, and therefore, it is pressed upon the drum 1 as it is in the first embodiment. Consequently, the charging roller 2 is placed in contact with the drum 1 across its entire range, being thereby readied for charging the drum 1. In this embodiment, the bearing 12 does not have the guiding portion 13, and the holding portion 14 of the bearing 12 does not have a groove for accommodating the metallic core 2*a*, being therefore simpler in shape. But, the same effects as those obtainable in ninth embodiment can be obtained.

Next, referring to FIGS. 16 and 17, the eleventh preferred embodiment of the present invention is described. This embodiment is another example of the modification of the ninth embodiment. In this embodiment, the supporting device 15 is not moved. The changing of the state of the charging roller 2 from the one in which the charging roller 2 is not under the pressure from the pressure applying member 11 to the one in which the charging roller 2 is kept under the pressure from the pressure applying member 11 is made by the movement of the charging roller 2 alone. The components of the cartridge 250 in this embodiment, which are not described, are the same in structure as the counterpart in the ninth embodiment. FIG. 16 is a schematic drawing for describing the mechanism, in this embodiment, for changing the state of the charging roller 2.

The supporting device 15 is solidly attached to the frame of the cartridge 250. Referring to FIG. 17(*a*), the bearing 12 of the supporting device 15 has a metallic core guiding portion 13 for smoothly guiding the metallic core 2*a* to the metallic core holding portion 14. The guiding portion 13 is a slanted surface. Further, the holding portion 14 has a semi-cylindrical groove for ensuring that the metallic core 2*a* remains in a preset position. The curvature of the groove is slightly larger than that of the metallic core 2*a*. The charging roller 2 (metallic core 2*a*) is held by the guiding portion 16*a* in such a manner that the metallic core 2*a* is allowed to move in the direction perpendicular to the direction in which the charging roller 2 is pressed by the pressure applying member 11, that is, the direction perpendicular to the direction indicated by an arrow F, within a preset range, that is, a range between where the metallic core 2*a* is supported by the guiding portion 16 alone, and where the metallic core 2*a* is supported by the supporting device 15 and remains pressed upon the drum 1 by the pressure applying member 11.

Next, referring to FIG. 16, the movement of the charging roller 2 is described. When the cartridge 250 is out of the apparatus main assembly 150A, the metallic core 2*a* of the charging roller 2 is not held by the holding portion 14 of the supporting device 15 as shown in FIG. 16(*a*). That is, the charging roller 2 is not under the pressure from the pressure applying member 11, being therefore not kept pressed upon the drum 1 (charging roller 2 is not in contact with drum 1). The charging roller 2 is held by the guiding portion 16*a*, being allowed to move within a preset range. The cartridge 250 is to be inserted into the apparatus main assembly 150A in the direction indicated by an arrow I as shown in FIG. 17(*b*). As the cartridge 250 is inserted, the first and second ends of the charging roller 2 come into contact (interfere) with a pair of supporting device movement assisting members 30, one for one, with which the apparatus main assembly 150A is provided. Then, as the cartridge 250 is inserted further, the charging roller 2 is moved in the direction indicated by an arrow E as shown in FIG. 16(*b*). That is, the charging roller 2 is moved in the direction perpendicular to the axial line of the charging roller 2. As the charging roller 2 is moved in the direction of the arrow E, that is, toward the supporting device 15, each of the first and second ends of the metallic core 2*a* comes into contact with the corresponding guiding portion 13, and is guided to the holding portion 14 by the force generated in the direction of the arrow F by the interaction between the peripheral surface of the metallic core 2*a* and guiding portion 13. Then, as the cartridge 250 is inserted further, each of the first and second ends of the metallic core 2*a* is eventually held by the corresponding holding portion 14, as shown in FIG. 16(*c*). As for the pressure applying member 11, it is compressed more than it was when it was in the state shown in FIG. 16(*a*), generating thereby the force for pressing the metallic core 2*a*. Thus, both the first and second ends of the charging roller 2 are pressed in the direction of the arrow F by a preset amount of force. Consequently, the charging roller 2 is placed in contact with the drum 1 across the entire range, being thereby readied for charging the drum 1. As will be evident from the description of this embodiment given above, according to this embodiment, the supporting device does not need to be made movable. That is, the cartridge 250 in this embodiment is simpler in structure than that in the ninth embodiment, and yet, has the same effects as those the cartridge 250 in the ninth embodiment has.

Embodiment 12

Next, referring to FIGS. 18 and 19, the twelfth preferred embodiment of the present invention is described. In this embodiment, the state of the charging roller 2 is changed from the one in which charging roller 2 is not kept pressed on the drum 1 by the pressure applying member 11, to the one in which the charging roller 2 is kept pressed on the drum 1 by the pressure applying member 11, by moving the supporting device 15 in the direction in which the charging roller 2 is pressed by the pressure applying member 11. The bearing 12 in this embodiment does not have the guiding portion 13. Further, the holding portion 14 of the bearing 12 does not have the groove for accommodating the metallic core 2*a*. Further, the end of the metallic core 2*a* is not tapered. The components of the cartridge 250 in this embodiment, which are not described, are the same in structure as the counterpart in the eleventh embodiment.

FIG. 18 is a schematic drawing for describing the mechanism, in this embodiment, for changing the state of the charging roller 2. Referring to FIG. 19(*a*), the supporting device 15 has the bearing 12 which has the holding portion 14 which keeps the charging roller 2*a* pressed toward the drum 1 while holding the metallic core 2*a*. Further, the supporting device 15 has a bearing guiding member 17, along which the bearing 12 slides in the direction indicated by an arrow F, that is, the direction in which the charging roller 2 is pressed toward the drum 1. Further, the supporting device 15 has a pressure applying member 11 for keeping the bearing 12 pressed in the direction of the arrow F. The supporting device 15 is attached to the cartridge frame in such a manner that it is movable in the direction indicated by an arrow E, which is the same direction as the direction of the arrow F, that is, the direction in which the charging roller 2 is kept pressed. The movement of the metallic core 2*a* is controlled by the guiding portion 16*a* in such a manner that the charging roller 2*a* is not allowed to move in the direction other than the direction (of arrow F) in which the charging roller 2 is kept pressed, as the metallic core 2*a* in the fifth embodiment described with reference to FIG. 7(*b*). The guiding portion 16*a* is a part of the cartridge 250.

Next, referring to FIG. 19(*b*), the movement of the supporting device 15 is described. When the cartridge 250 is not in the apparatus main assembly 150A, the supporting device 15 is in the inactive position A (second position), and the metallic core 2*a* is not held by the holding portion 14 of the supporting device 15, as shown in FIG. 18(*a*). Thus, the charging roller 2 is not under the pressure from the pressure applying member 11, and the charging roller 2 is not kept pressed on the drum 1 by the pressure applying member 11 (charging roller 2 is not in contact with drum 1). That is, the metallic core 2*a* is supported by the guiding portion 16*a* in such a manner that the metallic core 2*a* is allowed to move only in a preset range.

Referring to FIG. 19(*b*), the cartridge 250 has: a supporting device moving member 33 having a slanted surface 33*a* for moving the supporting device 15 in the direction indicated by an arrow E, that is, the direction in which the charging roller 2 is kept pressed; a supporting device lever 31, and a guide 32 for guiding the supporting device moving lever 31. As the cartridge 250 is inserted into the apparatus main assembly 150A, the lever 31 engages with the supporting device movement assisting member 30 of the apparatus main assembly 150A, and is moved by the supporting device movement assisting member 30 in the direction indicated by an arrow S. Thus, the supporting device 15 is moved by the interaction between the lever 31 and the slanted surface of the member 33 in the direction indicated by an arrow E. As the supporting device 15 is moved in the direction of the arrow E, the holding portion 14 comes into contact with the metallic core 2*a* as shown in FIG. 18(*b*). Then, as the cartridge 250 is moved further into the apparatus main assembly 150A, the supporting device 15 is moved further in the direction of the arrow E to a preset position B (first position). That is, as the cartridge 250 is inserted further, the pressure applying member 11 is compressed more than it was when it was in the state shown in FIG. 18(*a*), generating thereby the force for keeping the metallic core 2*a* pressed. Eventually, the first end of the metallic core 2*a* is held by the holding portion 14 while remaining pressed in the direction of the arrow F, that is, the direction in which the metallic core 2*a* (charging roller 2) is to be kept pressed, by a preset amount of pressure, as shown in FIG. 18(*c*). The other end (second end) of the metallic core 2*a* is held in the same manner as the first end. Thus, the charging roller 2 is placed in contact with the drum 1 across the entire range, being thereby readied for charging the drum 1. As will be evident from the description of this embodiment given above, even if the supporting device 15 does not have the guiding portion, and has only the holding portion which does not have the groove, as in this embodiment, and the ends of the metallic core 2*a* are not tapered, that is, even if the supporting device 15 is simple in structure, the same effects as those obtainable by the first embodiment can be obtained.

Embodiment 13

Referring to FIGS. 20 and 21, this Embodiment 13 will be described.

In this embodiment, the charging roller 2 is provided in the cartridge 250, and the supporting device 15 corresponding to one end of the charging roller 2 is disposed on the side of the main assembly 150A. The means for movement the charging roller 2 or the supporting device 15 used in Embodiments 1-11. The other end of the charging roller 2 is supported by the bearing device 19 provided on the side of the cartridge 250, similarly to Embodiment 1 and Embodiment 9. The structures not described are the same as with Embodiments 9.

Part (a) of FIG. 20 is a general arrangement, and FIG. 21 is a schematic view of a switching mechanism in this embodiment. The drum 1, the charging roller 2, the bearing device 19 and the guide portion 16*a* are provided in the cartridge 250 side, and the supporting device 15 is provided in the main assembly 150A side.

Part (a) of FIG. 21 illustrates the state in which the cartridge 250 is not mounted to the main assembly 150A. When the cartridge 250 is outside the main assembly 150A, the drum 1 and the charging roller 2 are contacted to each other by the weight of the charging roller 2, but are not urged by the urging member 11.

As shown in (a) of FIG. 20, the cartridge 250 is inserted in the direction of an arrow E relative to the main assembly 150A. The arrow E is perpendicular to the direction of urging by the urging member 11, that is, the direction of causing the core metal 2*a* and the bearing member 12 to each other.

Here, the urging direction of the urging member 11 is substantially the same as a guide direction of the guide portion 16*a* guiding the core metal 2*a*.

As shown in (b) of FIG. 20, the drum 1, the charging roller 2 and the guide portion 16*a* approaches to the supporting device 15 of the main assembly 150A. One end of the core metal 2*a* is introduced to the holding portion 14 while contacting the introducing portion 13 to receive a force in the direction of an arrow F. By the cartridge 250 being mounted to the main assembly 150A, as shown in (c) of FIG. 20, the urging member 11 is in a state compressed more than in the state shown in (a) of FIG. 20. By this, one end of the charging roller 2 is urged in the direction of an arrow F at a predetermined pressure.

Similarly to Embodiment 1, the other end of the core metal 2*a* is supported by the bearing device 19, and the other end becomes urged to the drum 1 as described in Embodiment 1. By this, the charging roller 2 becomes capable of charging the drum 1.

As described in the foregoing, in order to switch from the state that the charging roller 2 and the drum Tare not urged by the urging member 11 to the state that the charging roller 2 is urged thereto, no means for moving the supporting device 15 or charging roller 2 is required.

In addition, normally, the number of part of the cartridge 250 which is a consumable article can be reduced, since the supporting device 15 for the charging roller 2 provided in the cartridge 250 is provided in the main assembly.

In this embodiment, the supporting device 15 is used only in one end of the charging roller, but it may be provided in each of the opposite ends.

In this embodiment, the introducing portion is provided by the bearing configuration, but the structure shown in (b) of FIG. 20 eliminates the necessity of providing the introducing portion. More particularly, when the core metal 2*a* begins contacting the bearing member 12, an end of the holding portion 14 begins contacting the outer periphery of the core metal 2*a* at a side remote from the photosensitive drum 1 with respect to a flat surface P parallel to the arrow E and passing through the center of the core metal 2*a*. With such a structure, the introducing portion can be omitted.

In an alternative structure, the supporting device 15 provided in the main assembly 150A moves in the axial direction in interrelation with the drive for image forming operation. Thus, in this embodiment, in the case that the charging roller 2 is provided in the cartridge 250, and the supporting device 15 is provided in the main assembly 150A, there is provided an example of the switching mechanism for switching from the state that the charging roller is not urged to the drum by the urging member to the urged state.

However, the example is not restrictive to the present invention.

The image forming apparatus 150 of this embodiment is summarized as follows.

It is an image forming apparatus 150 includes a main assembly 150A to which a process cartridge 250 is detachably mountable, said process cartridge 250 including a rotatable image bearing member (drum 1) on which an image is to be formed and a rotatable roller (charging roller 2) which is rotated and contacted to said image bearing member at least during image forming operation.

It comprises a supporting device 15 for rotatably supporting a shaft 2*a* of said rotatable roller 2 at least during image forming operation, said supporting device including an urging member 11 for urging said rotatable roller 2 toward said image bearing member 1, and a bearing member 12 having a holding portion 14 for holding the shaft 2*a* of said rotatable roller 2 in a position where said rotatable roller 2 is contacted to said image bearing member 1 by said urging member 11.

In the apparatus, a relative movement between said rotatable roller 2 and said supporting device 15 is possible by an external force between a first position B in which the shaft 2*a* of said rotatable roller 2 is urged by said urging member 11 while being held by said holding portion 14, and a second position A in which the shaft 2*a* of said rotatable roller 2 is not held by said holding portion 14 and in which a distance between a rotation axis of said image bearing member 1 and an axis of said rotatable roller 2 is longer than that in the first position.

Since the supporting device for urging and supporting the rotatable roller 2 is provided in the main assembly 150 of the apparatus, the number of part of the process cartridge which is a consumable article can be reduced.

Embodiment 14

In this Embodiment 14, the charging roller 2 is provided in the main assembly 150A, and drum 1 is disposed in the cartridge 250 side, wherein the switching between the non-urging state of the charging roller 2 and the urging state is effected by movement of the supporting device 15 of the charging roller provided at opposite ends of the charging roller 2 in the main assembly.

Referring to FIGS. 22 and 23, the structures will be described. The description of the portions common with Embodiment 2 will be omitted.

FIG. 22 is a schematic view of the switching mechanism in this embodiment. The supporting device 15 and the guide portion 16*a* are provided in the cartridge 250.

As shown in (a) of FIG. 22, the charging roller 2 is in the state that it is not urged to the drum 1 by the urging member 11, and the core metal 2*a* of the charging roller 2 is not supported by the holding portion 14 by the supporting portion 14 of the supporting device 15. In this case, as shown in FIG. 23, the charging roller 2 moves away from the drum 1 by the weight thereof, and is held by the introducing portion 13 of the supporting device 15 provided at each of the opposite ends, in the state of not urged to the drum 1 by the urging member 11.

There is provided a guide portion 16*a* for preventing the charging roller 2 from disengaging by the vibration and/or tilting imparted when the cartridge 250 is not mounted to the main assembly 150A. By moving the supporting device 15 in the direction of the arrow E, the core metal 2*a* is brought into contact to the introducing portion 13 of the supporting device 15 and is introduced to the holding portion 14 while receiving a force in the direction of the arrow F which is the urging direction. As a result, as shown in the core metal 2*a* is held by the holding portion 14, and the urging member 11 is compressed more than in the state shown in (a) so that an urging force is produced, by which the charging roller 2 is contacted to the drum 1 in the state of being urged by the urging member 11 in the direction of the arrow F, thus the charging operation is enabled. The movement of the supporting device 15 is in interrelated with the driving of the image forming apparatus.

In this embodiment, the supporting device 15 is moved by an unshown mechanism interrelated with rotating operation of a motor for rotating the drum 1. More particularly, when the drum 1 rotates, the supporting devices 15 provided at the opposite ends of the charging roller 2 move toward each other so that the charging roller 2 is maintained in the urged state. When the rotation of the drum 1 stops, the supporting device 15 moves in the direction opposite the arrow E so that the charging roller 2 is switched into the non-urged state relative to the drum 1 as shown in (a).

By this, the charging roller 2 is contacted to the drum 1 only when the drum 1 is rotating, and therefore, the deformation of the contact portion of the charging roller 2 which may be caused by keeping the drum 1 and the charging roller 2 in the urged state for a long term can be avoided.

The image forming apparatus 150 of this embodiment is summarized as follows.

It is an image forming apparatus 150 including a main assembly 150A to which a process cartridge 250 is detachably mountable, said process cartridge 250 including a rotatable image bearing member (drum 1) on which an image is to be formed.

It includes a rotatable roller (charging roller 2) which is rotated and contacted to said image bearing member 1 at least during image forming operation.

It also includes a supporting device 15 for rotatably supporting a shaft 2*a* of said rotatable roller 2 at least during image forming operation, said supporting device 15 including an urging member 11 for urging said rotatable roller 2 toward said image bearing member 1, and a bearing member 12 having a holding portion 14 for holding a shaft 2*a* of said rotatable roller 2 in a position where said rotatable roller 2 is contacted to said image bearing member 1 by said urging member 11;

wherein a relative movement between said rotatable roller 2 and said supporting device 15 is possible by an external force between a first position B in which the shaft 2*a* of said rotatable roller 2 is urged by said urging member 11 while being held by said holding portion 14, and a second position A in which the shaft 2*a* of said rotatable roller 2 is not held by said holding portion 14 and in which a distance between a rotation axis of said image bearing member 1 and an axis of said rotatable roller 2 is longer than that in the first position B.

By this, the similar advantageous effects as with Embodiment 1 can be provided also in the structure in which the charging roller 2 and the supporting device 15 are provided in the main assembly 150A side.

That is, without using a complicated structure, the switching between the state that the charging roller tis not urged to the drum 1 by the urging member 11 and the urged state is possible, by the deformation at the contacting position can be reduced, and therefore, stable high image quality image formation can be accomplished.

In the foregoing, the examples of the rotatable roller have been a charging roller 2, but the present invention is not limited to such examples. The present invention is applicable to any roller-like member (rotatable roller) rotatably urged and contacted to drum 1. Other examples include a developing roller 7 and a transfer roller 10.

In addition, the supporting device 15 may be provided only at one end of the transfer roller 10, a bearing member not having the introducing portion can be used with the structure of the supporting device 15 similarly to those in Embodiment 8, Embodiment 10 and Embodiment 11.

The image formation system of the image forming apparatus is not limited to the electrophotographic image formation type of the embodiments.

Other examples are an electrostatic recording type using a dielectric member for electrostatic recording, a magnetic recording system using a magnetic member for magnetic recording as the image bearing member.

The present invention is not limited to the embodiments described above.

While the invention has been described with reference to the structures disclosed herein, it is not confined to the details set forth, and this application is intended to cover such modification or changes as may come within the purposes of the improvements or the scope of the following claims.

This application claims priority from Japanese Patent Application No. 054257/2010 filed Mar. 11, 2010 which is hereby incorporated by reference.

What is claimed is:

1. A process cartridge detachably mountable to a main assembly of an image forming apparatus, said process cartridge comprising:

a rotatable image bearing member on which an image is to be formed;

a rotatable roller which is rotated and contacted to said image bearing member at least during image forming operation; and a supporting device for rotatably supporting a shaft of said rotatable roller at least during the image forming operation, said supporting device including an urging member for urging said rotatable roller toward said image bearing member, a bearing member having a holding portion for holding the shaft of said rotatable roller in a position where said rotatable roller is contacted to said image bearing member by said urging member, wherein a relative movement between said rotatable roller and said supporting device is possible by an external force between a first position in which the shaft of said rotatable roller is urged by said urging member while being held by said holding portion, and a second position in which the shaft of said rotatable roller is not held by said holding portion and in which a distance between a rotation axis of said image bearing member and an axis of said rotatable roller is longer than that in the first position.

2. A process cartridge according to claim 1, wherein said supporting device is provided at each of one axial end and the other axial end of said rotatable roller.

3. A process cartridge according to claim 1, wherein said bearing member includes an introducing portion for guiding the shaft of said rotatable roller to said holding portion.

4. A process cartridge according to claim 1, further comprising a guide portion for guiding said rotatable roller in directions toward and away from said image bearing member in a predetermined region, said guide portion being provided with spacing means for keeping space between said rotatable roller and said image bearing member.

5. An apparatus according to claim 1, further comprising movement auxiliary means for relative movement between said rotatable roller and said supporting device between the first position and the second position.

6. An image forming apparatus to which a process cartridge is detachably mountable, said process cartridge including a rotatable image bearing member on which an image is to be formed and a rotatable roller which is rotated and contacted to said image bearing member at least during image forming operation, said image forming apparatus comprising:

a supporting device for rotatably supporting a shaft of said rotatable roller at least during image forming operation, said supporting device including an urging member for urging said rotatable roller toward said image bearing member, and a bearing member having a holding portion for holding the shaft of said rotatable roller in a position where said rotatable roller is contacted to said image bearing member by said urging member, wherein a relative movement between said rotatable roller and said supporting device is possible by an external force between a first position in which the shaft of said rotatable roller is urged by said urging member while being held by said holding portion, and a second position in which the shaft of said rotatable roller is not held by said holding portion and in which a distance between a rotation axis of said image bearing member and an axis of said rotatable roller is longer than that in the first position.

7. An apparatus according to claim 6, wherein said supporting device is provided at each of one axial end and the other axial end of said rotatable roller.

8. An apparatus according to claim 6, wherein said bearing member includes an introducing portion for guiding the shaft of said rotatable roller to said holding portion.

9. An apparatus according to claim 6, further comprising a guide portion for guiding said rotatable roller in directions toward and away from said image bearing member in a predetermined region, said guide portion being provided with spacing means for keeping space between said rotatable roller and said image bearing member.

10. An apparatus according to claim 6, further comprising movement auxiliary means for relative movement between said rotatable roller and said supporting device between the first position and the second position.

11. An image forming apparatus to which a process cartridge is detachably mountable, said process cartridge including a rotatable image bearing member on which an image is to be formed, said image forming apparatus comprising:

a rotatable roller which is rotated and contacted to said image bearing member at least during image forming operation; and a supporting device for rotatably supporting the shaft of said rotatable roller at least during image forming operation, said supporting device including an urging member for urging said rotatable roller toward said image bearing member, and a bearing member having a holding portion for holding a shaft of said rotatable roller in a position where said rotatable roller is contacted to said image bearing member by said urging member;

wherein a relative movement between said rotatable roller and said supporting device is possible by an external force between a first position in which the shaft of said rotatable roller is urged by said urging member while being held by said holding portion, and a second position in which the shaft of said rotatable roller is not held by said holding portion and in which a distance between a rotation axis of said image bearing member and an axis of said rotatable roller is longer than that in the first position.

12. An apparatus according to claim 11, wherein said supporting device is provided at each of one axial end and the other axial end of said rotatable roller.

13. An apparatus according to claim 11, wherein said bearing member includes an introducing portion for guiding the shaft of said rotatable roller to said holding portion.

14. An apparatus according to claim 11, further comprising a guide portion for guiding said rotatable roller in directions toward and away from said image bearing member in a predetermined region, said guide portion being provided with spacing means for keeping space between said rotatable roller and said image bearing member.

15. An apparatus according to claim 11, further comprising movement auxiliary means for relative movement between said rotatable roller and said supporting device between the first position and the second position.

* * * * *